United States Patent [19]

Vulcano et al.

[11] 4,094,128

[45] June 13, 1978

[54] AUTOMATIC BAGGING MACHINE

[75] Inventors: Vincent N. Vulcano, New York, N.Y.; Maurice W. Friedman, 548 Barnard Ave., Woodmere, N.Y. 11598

[73] Assignee: Maurice W. Friedman, Woodmere, N.Y.

[21] Appl. No.: 722,322

[22] Filed: Sep. 10, 1976

[51] Int. Cl.[2] ..... B65B 57/00; B65B 5/04

[52] U.S. Cl. ..... 53/52; 53/66; 53/241

[58] Field of Search ..... 53/29, 52, 66, 183, 53/241, 256, 384–386

[56] References Cited

U.S. PATENT DOCUMENTS

| | | | |
|---|---|---|---|
| 3,735,557 | 5/1973 | Hoffarth et al. | 53/183 |
| 3,802,156 | 4/1974 | Dahlberg | 53/384 |
| 3,895,480 | 7/1975 | Lombardo | 53/241 X |
| 3,965,653 | 6/1976 | Lerner | 53/187 |
| 3,974,628 | 8/1976 | Konstantin | 53/291 |
| 3,982,377 | 9/1976 | Vanderpool | 53/241 X |

*Primary Examiner*—Robert Louis Spruill
*Attorney, Agent, or Firm*—Stephen E. Feldman; Marvin Feldman

[57] ABSTRACT

An automatic bagging machine for placing transparent plastic bags over garments so as to enclose individual garments. The apparatus includes a turntable which has a number of upright garment stands, and an indexing system for rotating the turntable. The garments are carried by the stands on the turntable from a loading station to an operative station and then to an unloading station. The apparatus also includes an assembly for placing a plastic tube from a supply of plastic tubular material over a garment located at the loading station and then cutting and sealing this tube at an upper portion to form a transparent bag for the garment. Thereafter, the garment in its bag is moved to the unloading station and then is transported to a storage rack.

44 Claims, 23 Drawing Figures

112
116
24
334
338
336
22
26
333
335
337
339
345
344
353
286
350
282
347
352
352
384
382
D1

384
286
382
16
351
353
22
26
D1
356
352
282
352
347
336
112
345
334
338
333
116
114

D7-N.C.
D7-N.O.
806
BLIM
D8
M
826
880
808
CLR
TOP
DE
ONHK
TGARD
826
809
800
ROM
802
812-M
810
A5
AB0
AB1
AB2
AB3
DB7
M
φ1
C
828
E/R
COUNTER
DB6
DE
812-DE
824
812-CC
A7
DB5
CC
822
812-CO
A8
DB4
CO
804
812-SP
820
A4
AB4
AB5
AB6
AB7
R
DB3
SP
A3
C
E/R
COUNTER
812-CG
DB2
CG
A2
812-R
818
28C
814
816
A1
DB1
R
A6
812-TRN
DB0
TRN

FIG. 22

| ADR. | DATA | ADR. | DATA | ADR. | DATA | ADR. | DATA |
|---|---|---|---|---|---|---|---|
| 0 | 0000 0000 | 34 | 0100 1100 | 68 | 0000 1100 | 102 | 1000 0110 |
| 1 | 0000 0000 | 35 | 0100 1100 | 69 | 0000 1100 | 103 | 1000 0110 |
| 2 | 0000 0000 | 36 | 0100 1100 | 70 | 0000 1100 | 104 | 1000 0110 |
| 3 | 0000 0000 | 37 | 0100 1100 | 71 | 1000 1100 | 105 | 1000 0111 |
| 4 | 0000 0000 | 38 | 0000 1100 | 72 | 1000 1100 | 106 | 1000 0111 |
| 5 | 0000 0000 | 39 | 0000 1100 | 73 | 1000 1100 | 107 | 1000 0111 |
| 6 | 0000 0000 | 40 | 0010 1100 | 74 | 1000 1100 | 108 | 1000 0111 |
| 7 | 0000 0000 | 41 | 0010 1100 | 75 | 1000 1100 | 109 | 1000 0111 |
| 8 | 0000 0000 | 42 | 0010 1100 | 76 | 1000 1100 | 110 | 1000 0111 |
| 9 | 0000 0000 | 43 | 0010 1100 | 77 | 1000 1000 | 111 | 1000 0111 |
| 10 | 0000 0100 | 44 | 0010 1100 | 78 | 1000 1000 | 112 | 1000 0111 |
| 11 | 0000 0100 | 45 | 0010 1100 | 79 | 1000 1000 | 113 | 1000 0111 |
| 12 | 0000 0100 | 46 | 0010 1100 | 80 | 1000 1000 | 114 | 1000 0111 |
| 13 | 0000 0100 | 47 | 0010 1100 | 81 | 1000 1000 | 115 | 1100 0010 |
| 14 | 0000 0100 | 48 | 0010 1100 | 82 | 1000 1000 | 116 | 1100 0010 |
| 15 | 0000 0100 | 49 | 0010 1100 | 83 | 0000 0000 | 117 | 1100 0010 |
| 16 | 0000 0100 | 50 | 0000 1100 | 84 | 0000 0000 | 118 | 1100 0010 |
| 17 | 0000 0100 | 51 | 0000 1100 | 85 | 0000 0010 | 119 | 1100 0010 |
| 18 | 0000 0100 | 52 | 0000 1100 | 86 | 0000 0010 | 120 | 1100 0010 |
| 19 | 0000 0100 | 53 | 0000 1100 | 87 | 0000 0010 | 121 | 1100 0010 |
| 20 | 0000 1100 | 54 | 0000 1100 | 88 | 0000 0010 | 122 | 1100 0010 |
| 21 | 0000 1100 | 55 | 0001 1100 | 89 | 0000 0010 | 123 | 1100 0010 |
| 22 | 0000 1100 | 56 | 0001 1100 | 90 | 0000 0010 | 124 | 1100 0010 |
| 23 | 0000 1100 | 57 | 0001 1100 | 91 | 0000 0010 | 125 | 0000 0000 |
| 24 | 0000 1100 | 58 | 0001 1100 | 92 | 0000 0010 | 126 | 0000 0000 |
| 25 | 0000 1100 | 59 | 0001 1100 | 93 | 0000 0010 | 127 | 0000 0000 |
| 26 | 0000 1100 | 60 | 0001 1100 | 94 | 0000 0010 | 128 | 0000 0000 |
| 27 | 0000 1100 | 61 | 0001 1100 | 95 | 1000 0110 | 129 | 0000 0000 |
| 28 | 0000 1100 | 62 | 0001 1100 | 96 | 1000 0110 | 130 | 0000 0000 |
| 29 | 0000 1100 | 63 | 0001 1100 | 97 | 1000 0110 | 131 | 0000 0000 |
| 30 | 1100 1100 | 64 | 0001 1100 | 98 | 1000 0110 | 132 | 0000 0000 |
| 31 | 1100 1100 | 65 | 0000 1100 | 99 | 1000 0110 | 133 | 0000 0000 |
| 32 | 1100 1100 | 66 | 0000 1100 | 100 | 1000 0110 | 134 | 0000 0000 |
| 33 | 1100 1100 | 67 | 0000 1100 | 101 | 1000 0110 | 135 | 0000 0000 |

AUTOMATIC BAGGING MACHINE

The present invention relates to apparatus for continuously and automatically placing lengths of transparent plastic tubes from a supply of plastic tubular material, over garments and cutting and sealing these plastic tubes so as to form garment bags for such garments on an individual basis. More specifically, the present apparatus relates to an apparatus which initiates with a garment placed on a turntable, rotates such garment in turn from the station at which it has been loaded to an operative station, places a transparent plastic tube from a supply over the garment at the operative station and cuts and seals the tube to form a garment bag for the garment, the garment bag having a length only slightly longer than the length of the garment, then moves the garment in its bag to an unloading station, and finally transports the garment in its bag to a storage rack.

Bagging machines which operate in either an automatic or semi-automatic manner to place transparent plastic tubes over garments and to cut and seal such tubes so as to form garment bags for garments have been known for several years. U.S. Pat. Nos. 3,755,984 and 3,895,480 are typical of this prior art. In general these prior art machines are excessively complex from both a mechanical and electrical point of view, and therefore are usually subject to excessive "down" time, and are also quite expensive so that they cannot be as a practical manner utilized by garment manufacturers. Further, in main these prior art bagging machines cannot be used or are quite difficult to use on transparent plastic tubular material of different diameters or of different film thicknesses. These prior art machines often tear this plastic tubular material, so that they must be restored to proper working condition by an operator. Still further, in general these prior art bagging machines do not have an adequate capability for forming transparent bags of a length which is adjustable as a function of the length of the garment to be bagged.

Accordingly, it is the primary object of the present invention to provide an apparatus for bagging garments which operates in a fully automatic manner, which is relatively simple from a machanical and electrical point of view and which will continue to operate over long periods of time and with large numbers of garments with a minimum of maintenance and a minimum of service by an operator.

It is a further object of the present invention to provide an automatic bagging apparatus of a character described which functions to transport garments from a loading station to an operative station at which the garments are bagged, to an unloading station and then to a storage rack on a pre-programmed basis, all without the intervention of an operator.

It is still a further object of the present invention to provide an automatic bagging apparatus of the character described which unrolls a length of plastic transparent tubular material from a roll of such material and which thereupon places a length of such a tube over a garment in a manner such that the plastic tube is neither torn nor stretched.

It is still a further object of the present invention to provide an automatic bagging apparatus of the character described which forms a garment bag over a garment, and which causes the bag to have a length which is a function of the length of the garment, and which can perform this function of tailoring the length of the bag to the length of the garment without intervention of an operator.

It is yet another object of the present invention to provide an automatic bagging apparatus of the character described which includes means for separating the faces of the tubular plastic material and for preventing these faces from sticking together after they have been spread apart so as to allow the tubular material to be placed over a garment in an easy and quick manner.

It is yet a further object of the present invention to provide an automatic bagging apparatus of the character described which has the capacity to operate on tubular plastic material of different widths, by an easy adjustment of the apparatus by an operator.

In general, and in accordance with the principles of the present invention, there is provided an apparatus for automatically bagging garments. The apparatus includes a turntable upon which are stationed a number of, and desirably four, garment stands. Each garment stand has at its upper end a hook for receiving and holding a garment hanger, on which a garment has been placed. The turntable with its stands is rotated so that each stand moves from a loading position, to an operative position, to an intermediate position, to an unloading position. Indexing means is provided so that after a garment is placed on a stand which is at the loading position, the stand is then intermittently rotated through each of these positions in turn, according to a prescribed control.

The apparatus is provided with a supply of tubular transparent plastic material in the form of a roll. Means is provided to unroll the tubular material from the roll. Other means, including a vacuum means and a series of hollow spherical balls functioning as separators, separate the faces of the roll so that they remain temporarily apart and form a generally rectangular opening, when the material is at a location adjacent to the operative position. When a garment on a stand has been brought to the operative position, gripping means, actuated by a controller, is elevated upwardly to grab the free end of the tubular material, the faces of which are still separated. The gripping means then draws the tubular material downwardly over the garment at the operative position. Sensing means both detects the presence of a garment and with the controller, controls the gripping means to draw the tubular material over the garment to a point such that the free end of the tubular material will eventually be beyond the lower edge of the garment. Thereafter, sealing means heat seals the tubular material at a location above the garment and cutting means cuts the garment bag transversely of its length at approximately the same location. Thereby, a garment bag is formed having a length tailored to the length of the garment inside of it. Then, the indexing means rotates the garment through an intermediate position to the unloading position. From the unloading position, further discharge means transports the garment in its garment bag to a storage rack, for subsequent disposition by a garment maufacturer.

Further objects, features and advantages of the invention will become apparent upon consideration of the following detailed description in conjunction with the drawings, in which.

Figure 3:
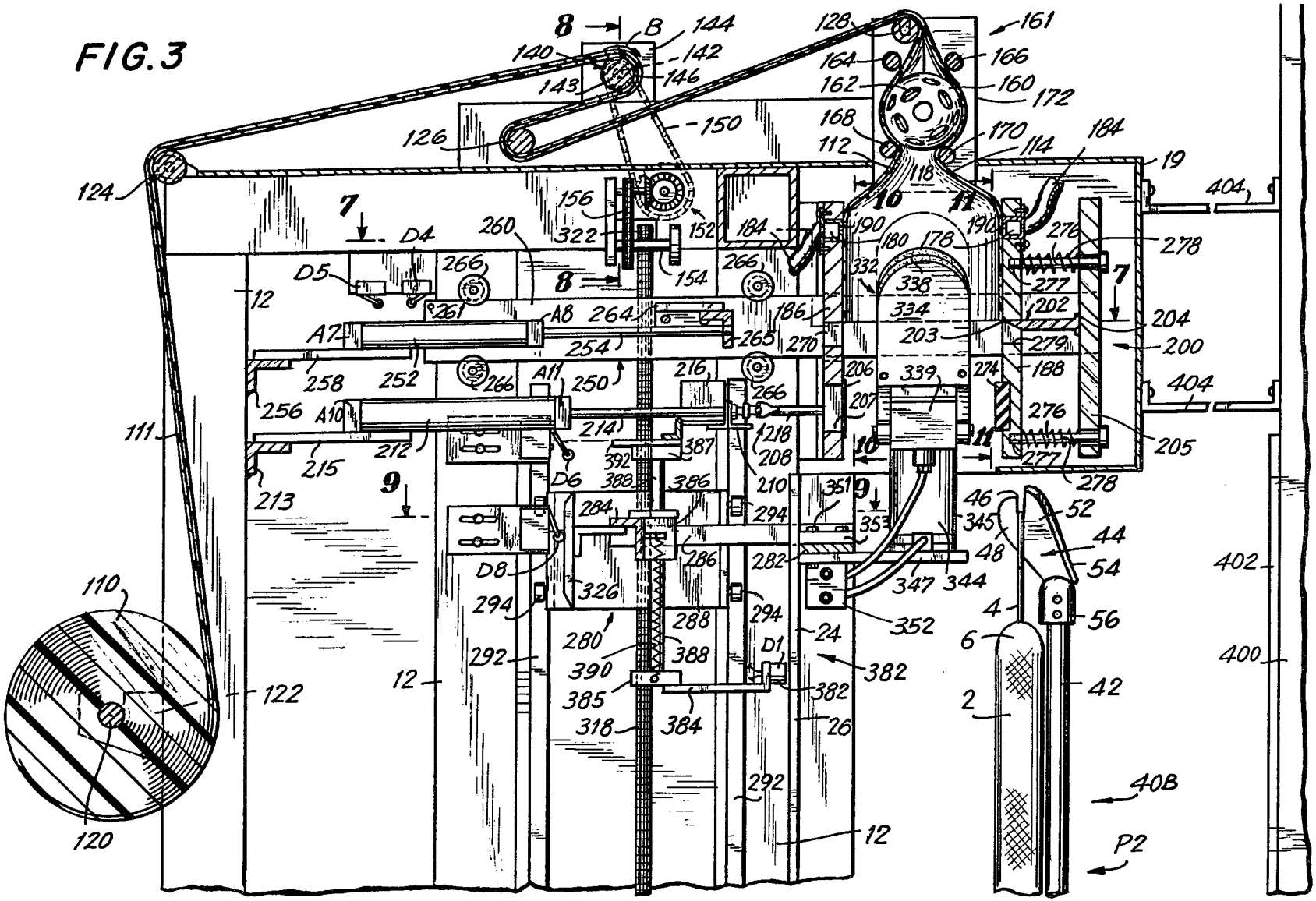
FIG. 3 is a detailed cross-sectional view of the apparatus taken substantially along the line 3—3 of FIG. 2.
Figure 12:
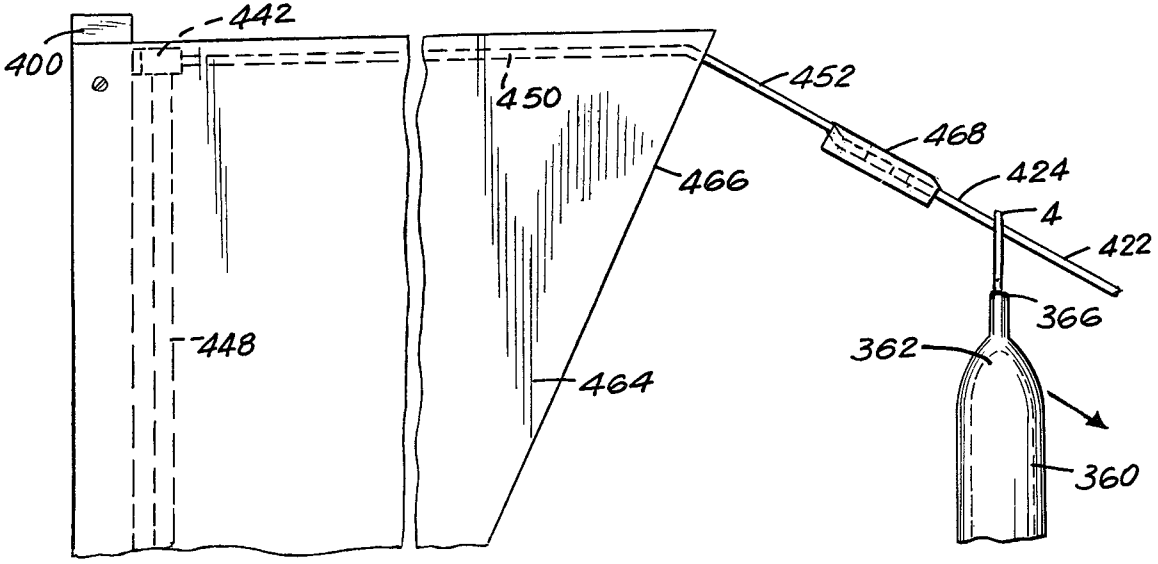
Figure 10:
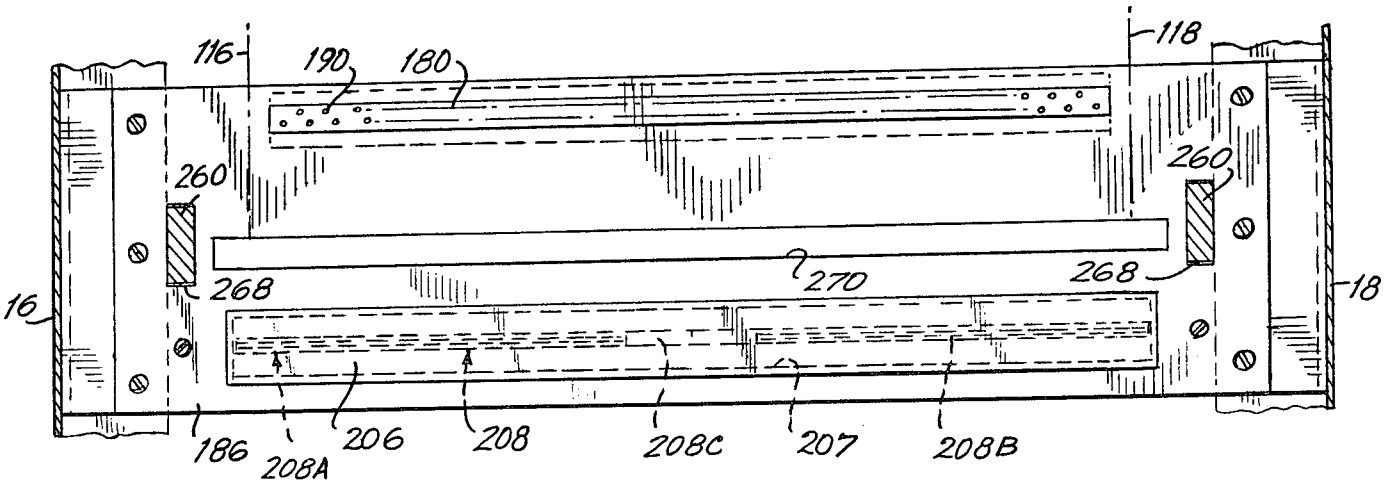
Figure 11:
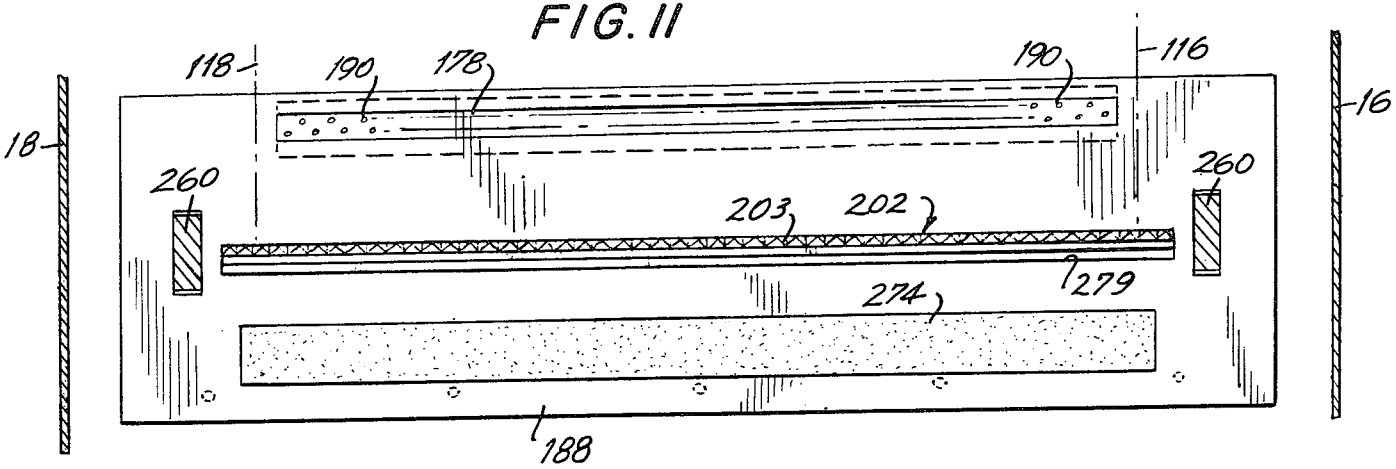
Figure 13:
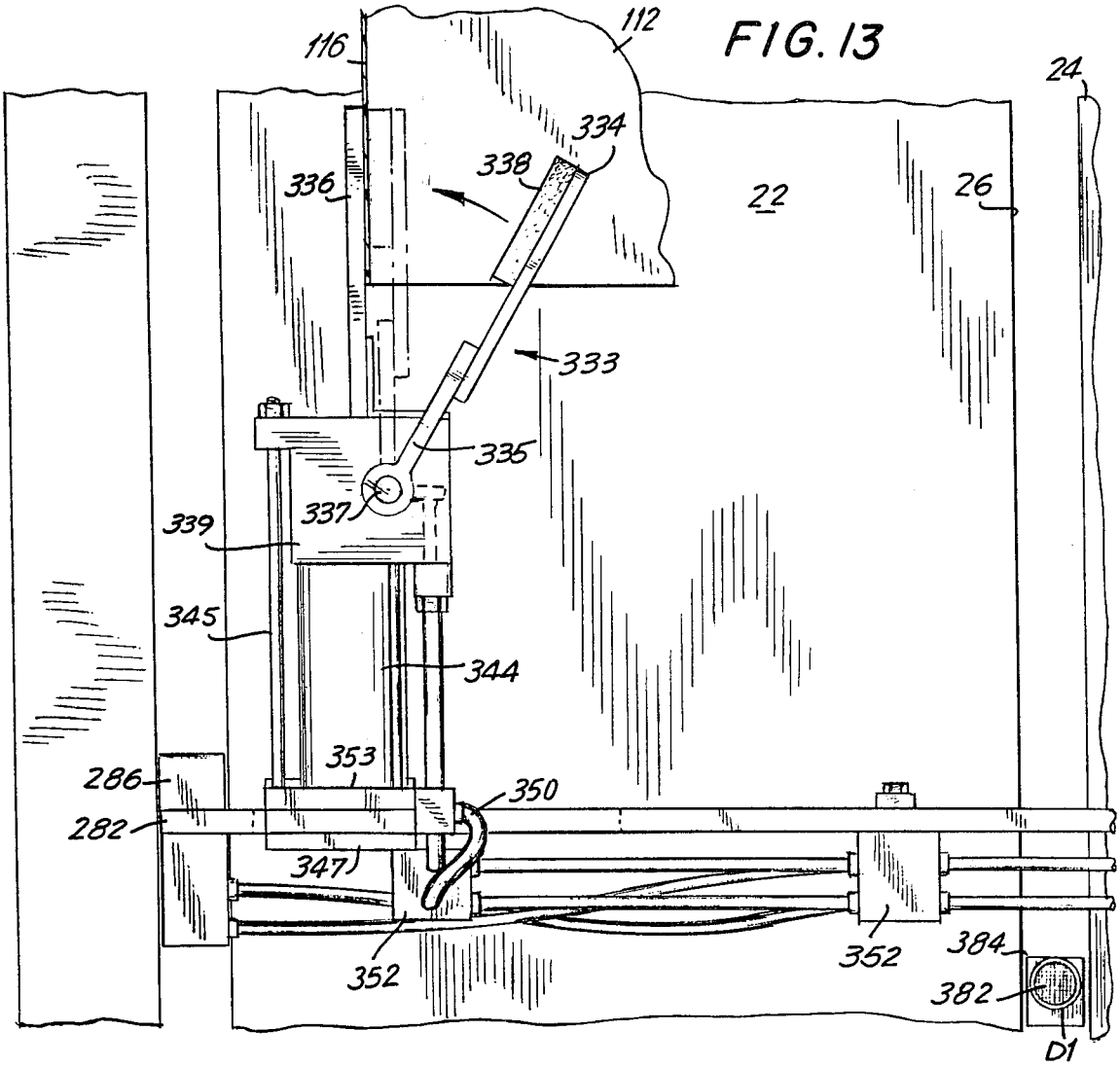
Figure 14:
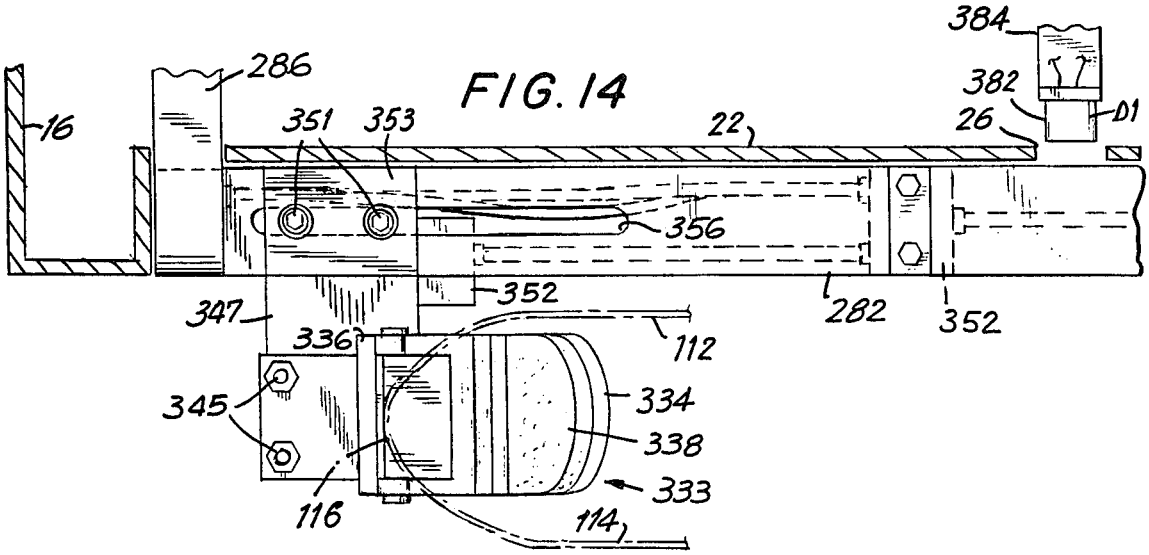
Figure 15:
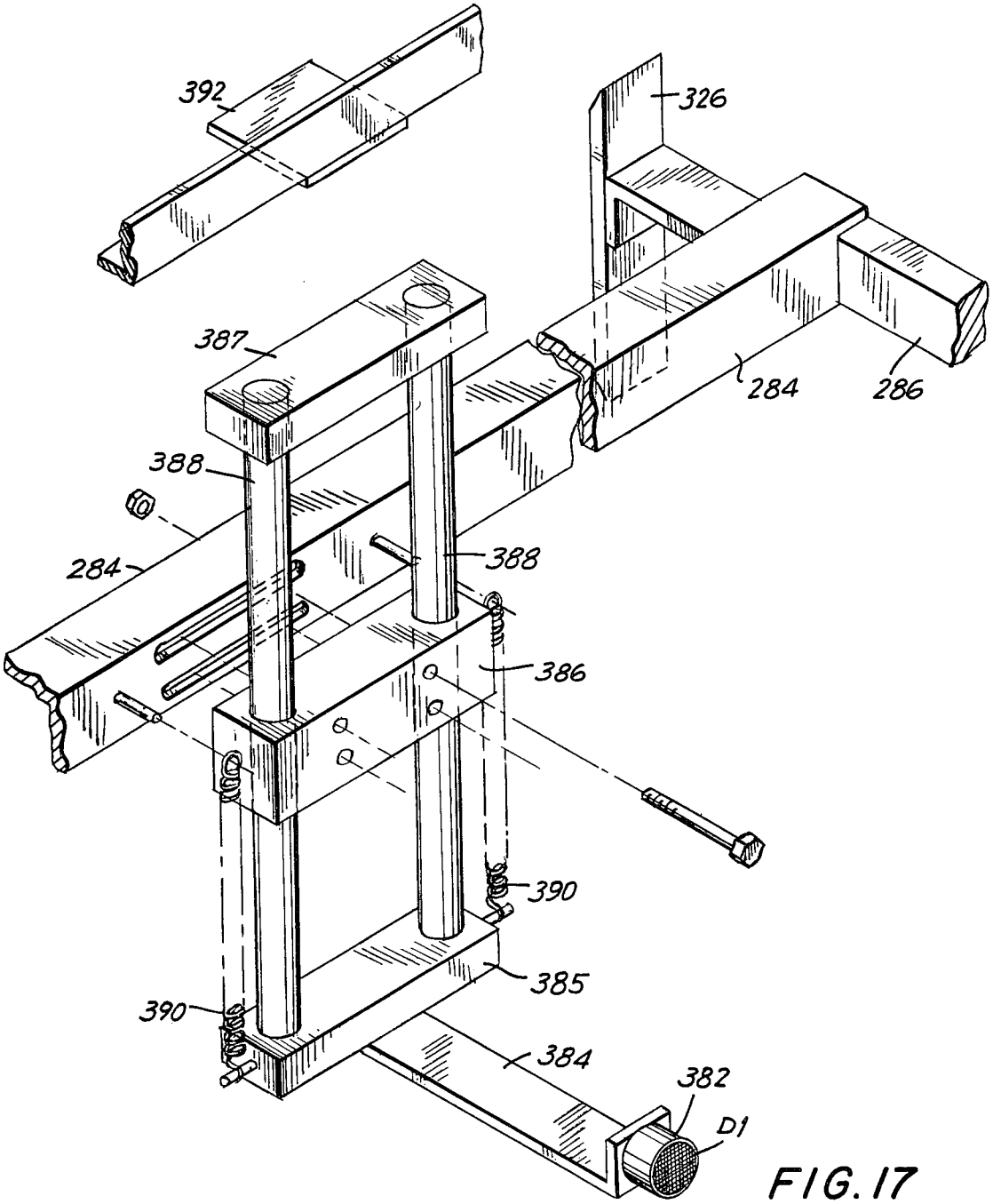
Figure 16:
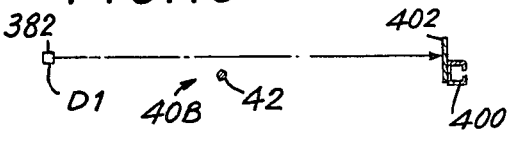
Figure 17:
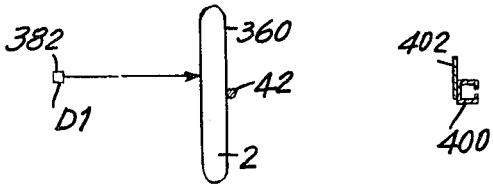
Figure 18:
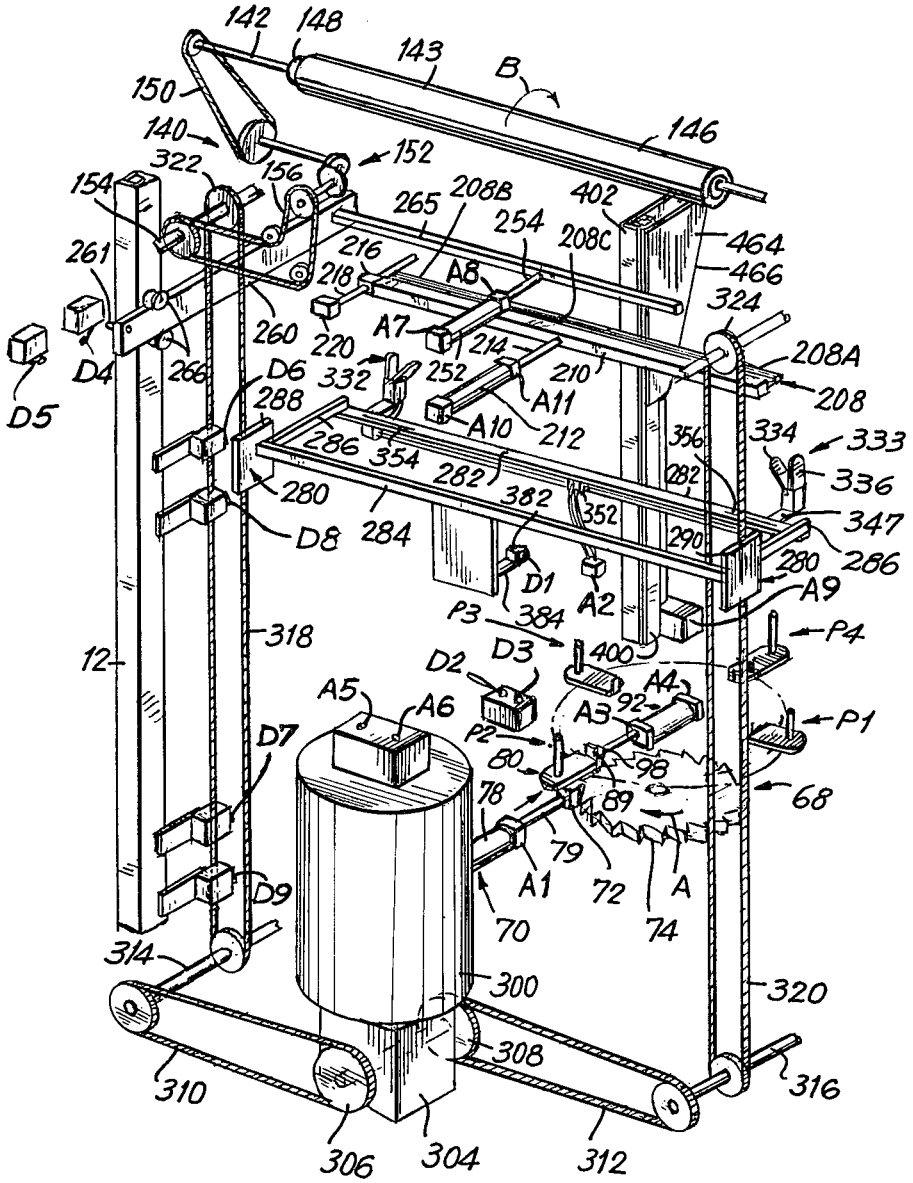
Figure 19:
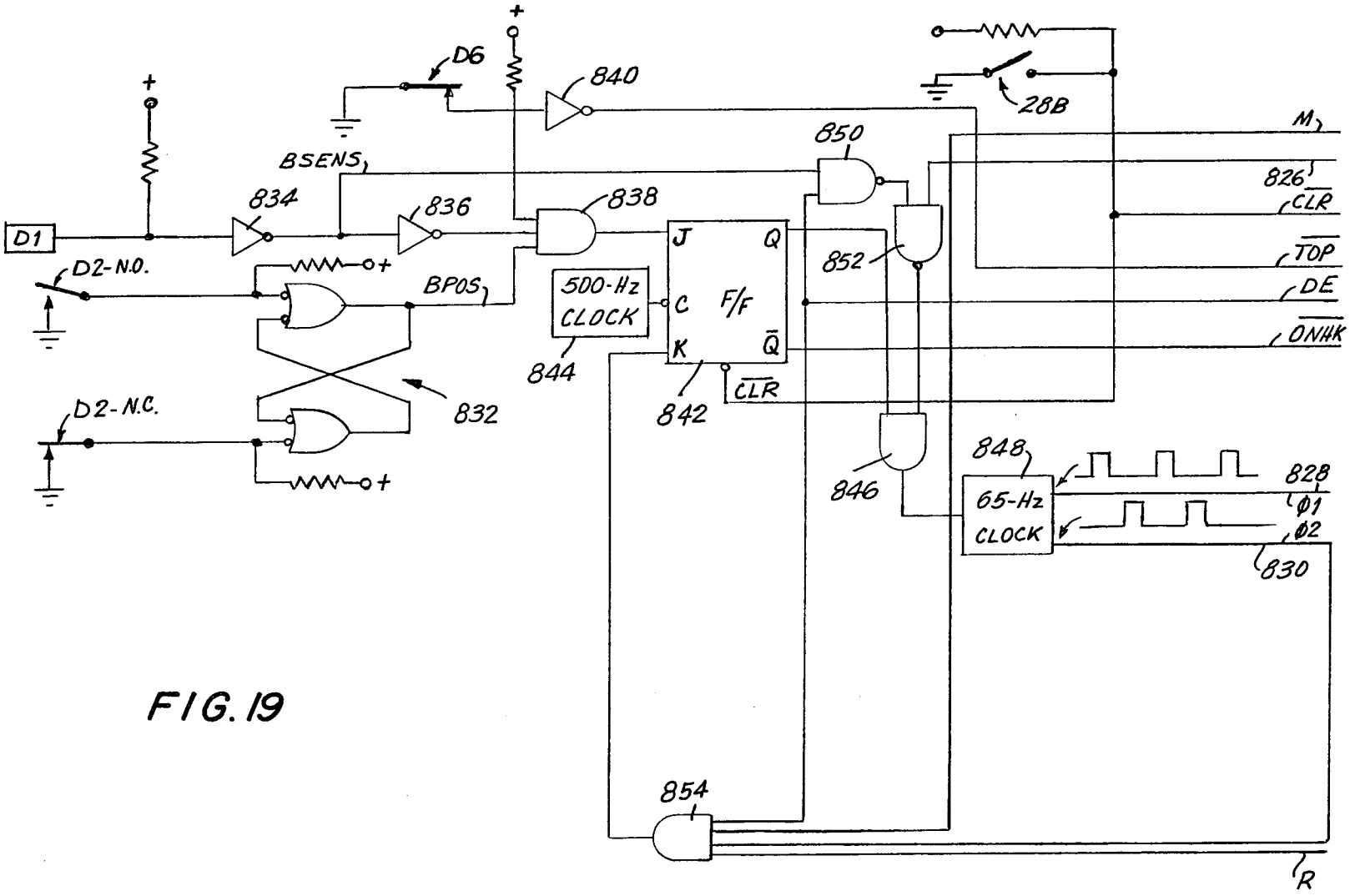
Figure 20:
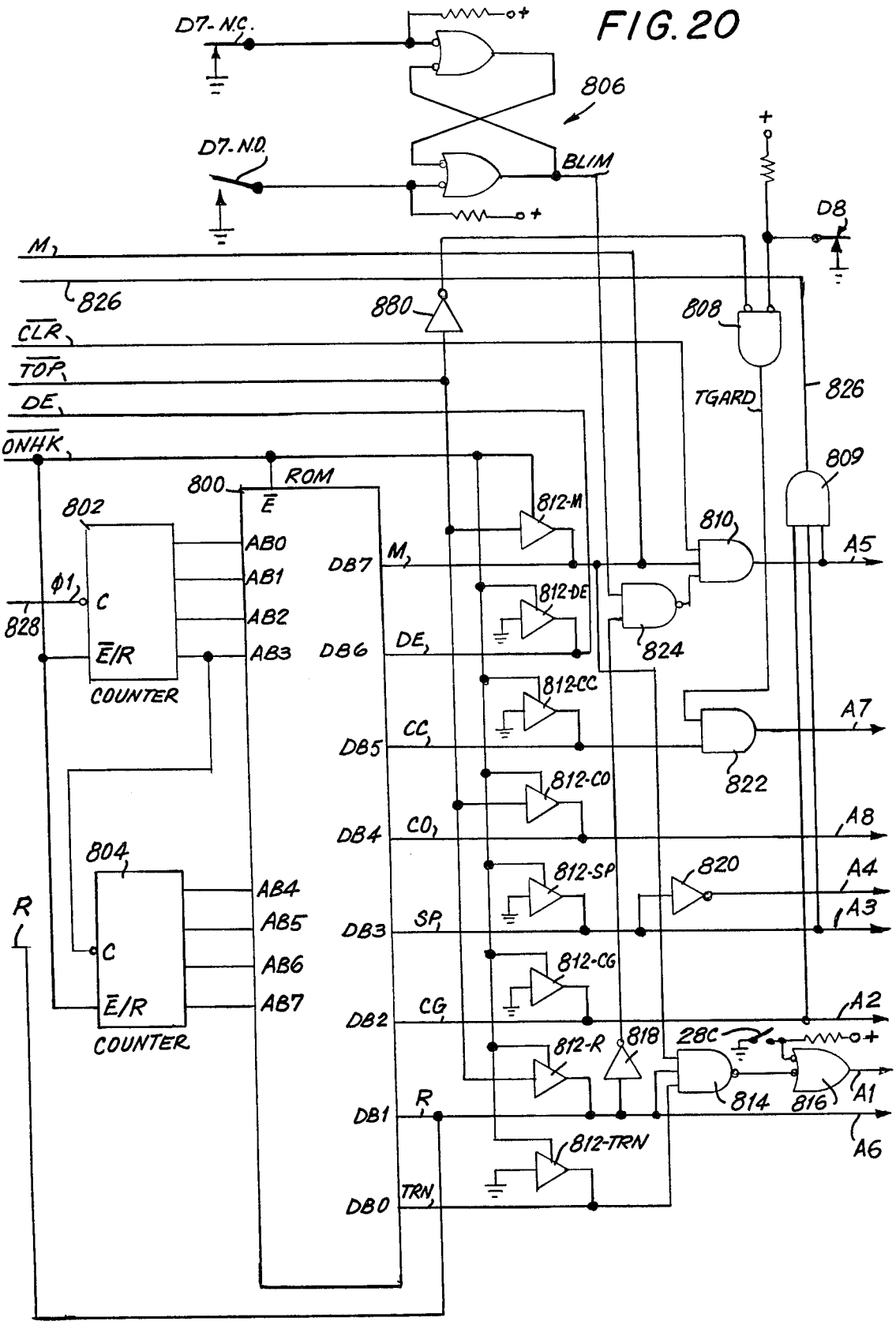
Figure 21:
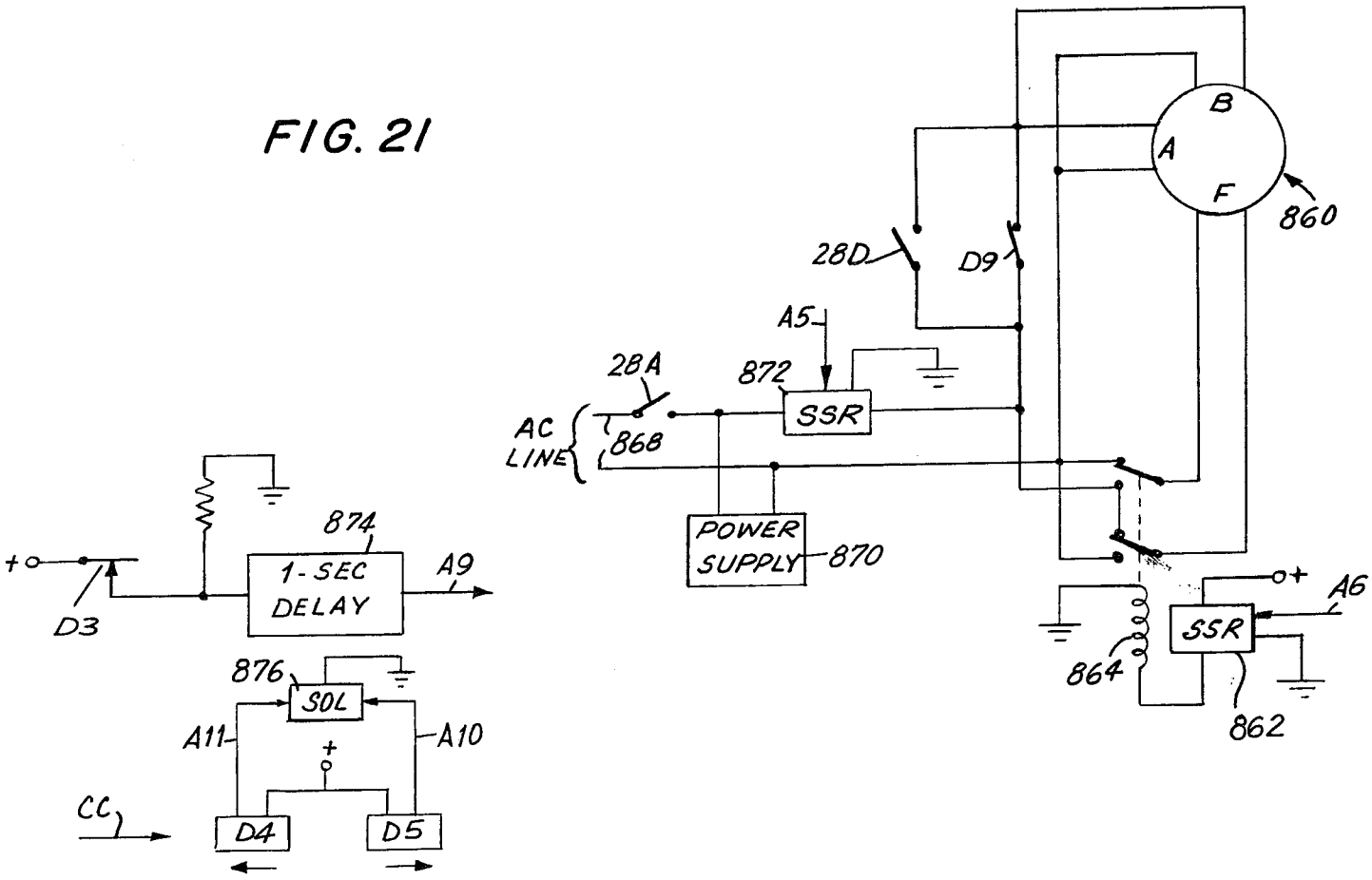

FIGS. 10 and 11 are sectional views taken along the lines 10—10 and 11—11 of FIG. 3 showing components of the cutting and sealing means;

FIG. 12 is a fragmentary exploded view of the camming means of the garment discharging system;

FIGS. 13 and 14 are respectively a side elevational view and top plan view of the gripping means;

FIG. 15 is an exploded perspective view of the sensing means;

FIGS. 16 and 17 are diagramatic views of the operation of the sensing means;

FIG. 18 is a schematic view of the apparatus showing primarily the various actuators and detectors which operate in connection with the controller;

FIGS. 19 and 20, with FIG. 19 being placed to the left of FIG. 20, depict most of the circuitry of the controller for sequencing the machine;

FIG. 21 depicts the remainder of the circuitry in the controller; and

FIG. 22 is a table indicating the data stored at each location of read-only-memory 800 of FIG. 20.

Figure 1:
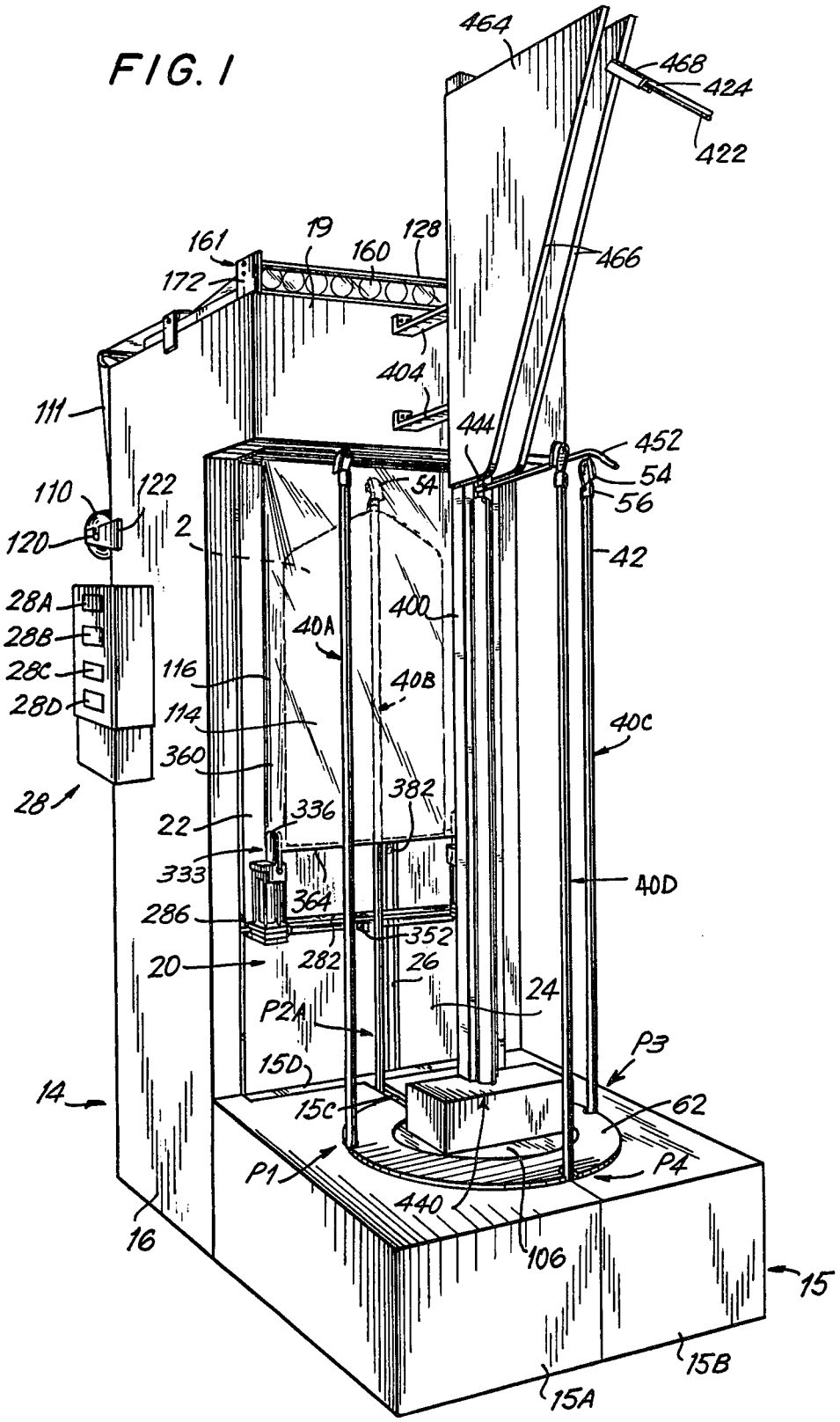
FIG. 1 is a front perspective view of the automatic bagging machine of the present invention.
Figure 2:
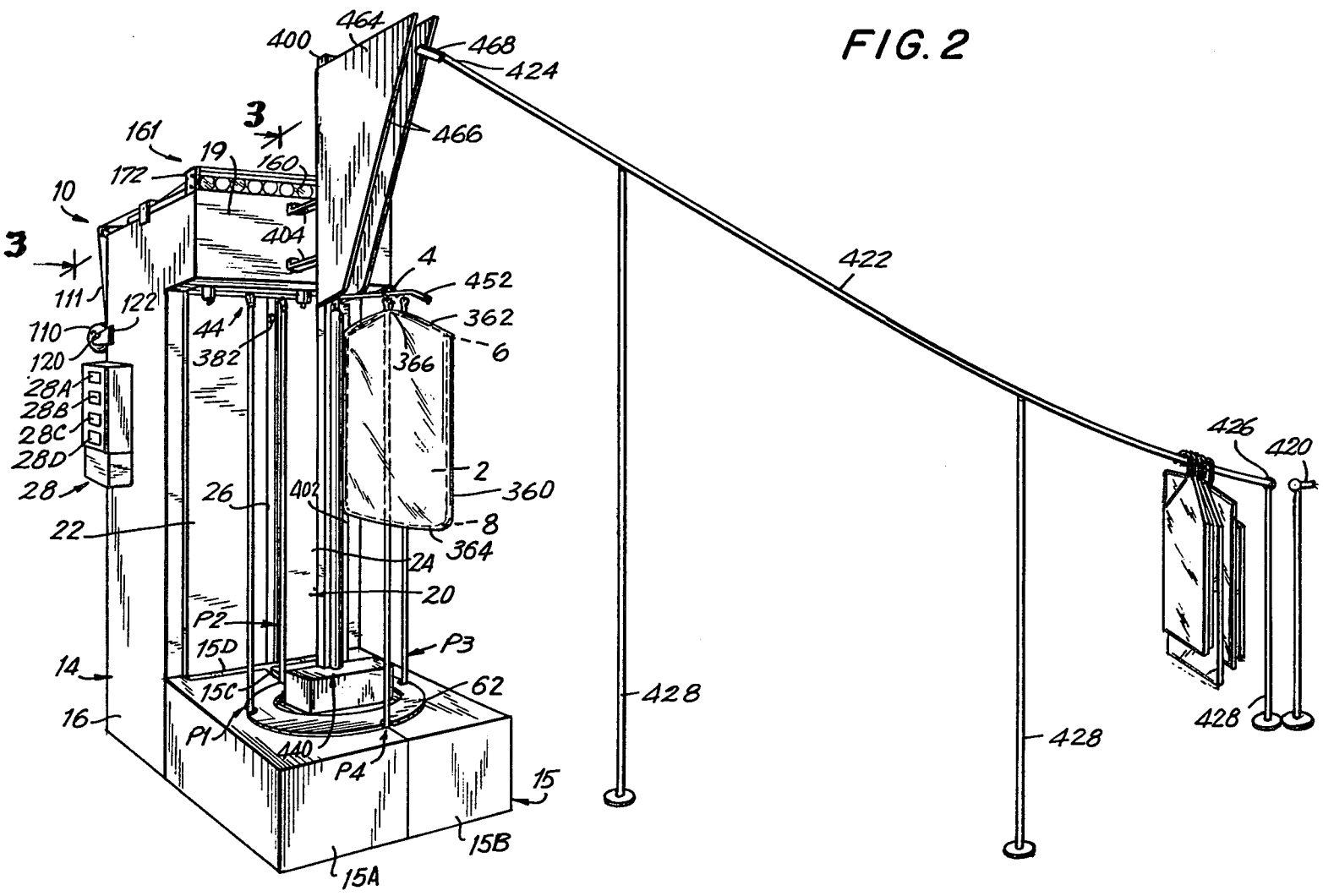
FIG. 2 is a view generally similar to FIG. 1, but showing in addition means for moving bagged garments from the turntable to a garment storage rack.

As best seen in FIGS. 1 and 2, the present invention operates upon a garment 2 of a type which would be made by a garment manufacturer and which could be an item of men's wear, women's wear or children's wear. As will be seen hereafter, the garments 2 may be presented to the present apparatus in mixed fashion, that is, a number of men's garments, a number of women's garments and a number of children's garments, which are intermixed, and which are of various sizes, including lengths and widths. Each garment has been hung upon a hanger, of any standard type. For purposes to be explained later, each garment has an upper edge 6 and a lower edge 8.

Each garment 2 is operated upon by the present apparatus 10, having in general an internal frame 12 and a base 13. A housing 14 is fixed to the frame 12 and a base housing 15 is fixed to the base 13. The housing 14 is made up of a number of panels. More specifically, the housing has side panels 16 and 18, an upper front panel 19 and a lower front panel 20. The lower front panel 20 is in turn made up of a pair of walls 22, 24 between which is formed a vertical elongated slot 26. The base housing 15 comprises a pair of housing halves 15A, 15B which abut at their forward portion and which define at their rear an open ended slot 15C and a longer transverse opening 15D. A controller housing 28 for controller means, later to be described in detail, is fixed to side panel 16. Switches 28A, 28B, 28C and 28D are carried on housing 28, and will be described subsequently.

Figure 4:
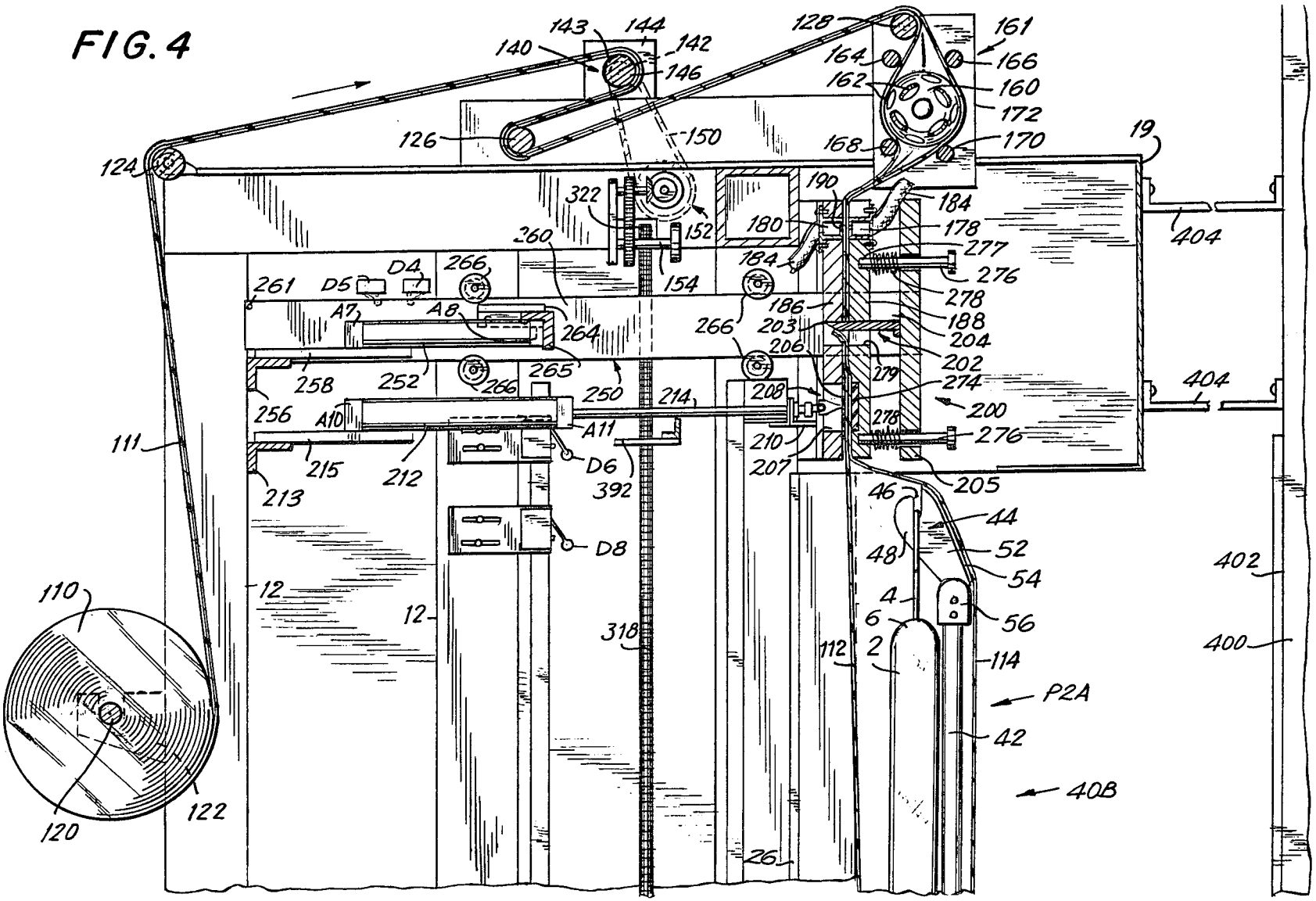
FIG. 4 is a view similar to FIG. 3 but showing the tubular material pressed together, immediately above a garment on a stand at the operative position.
Figures 5, 5A:
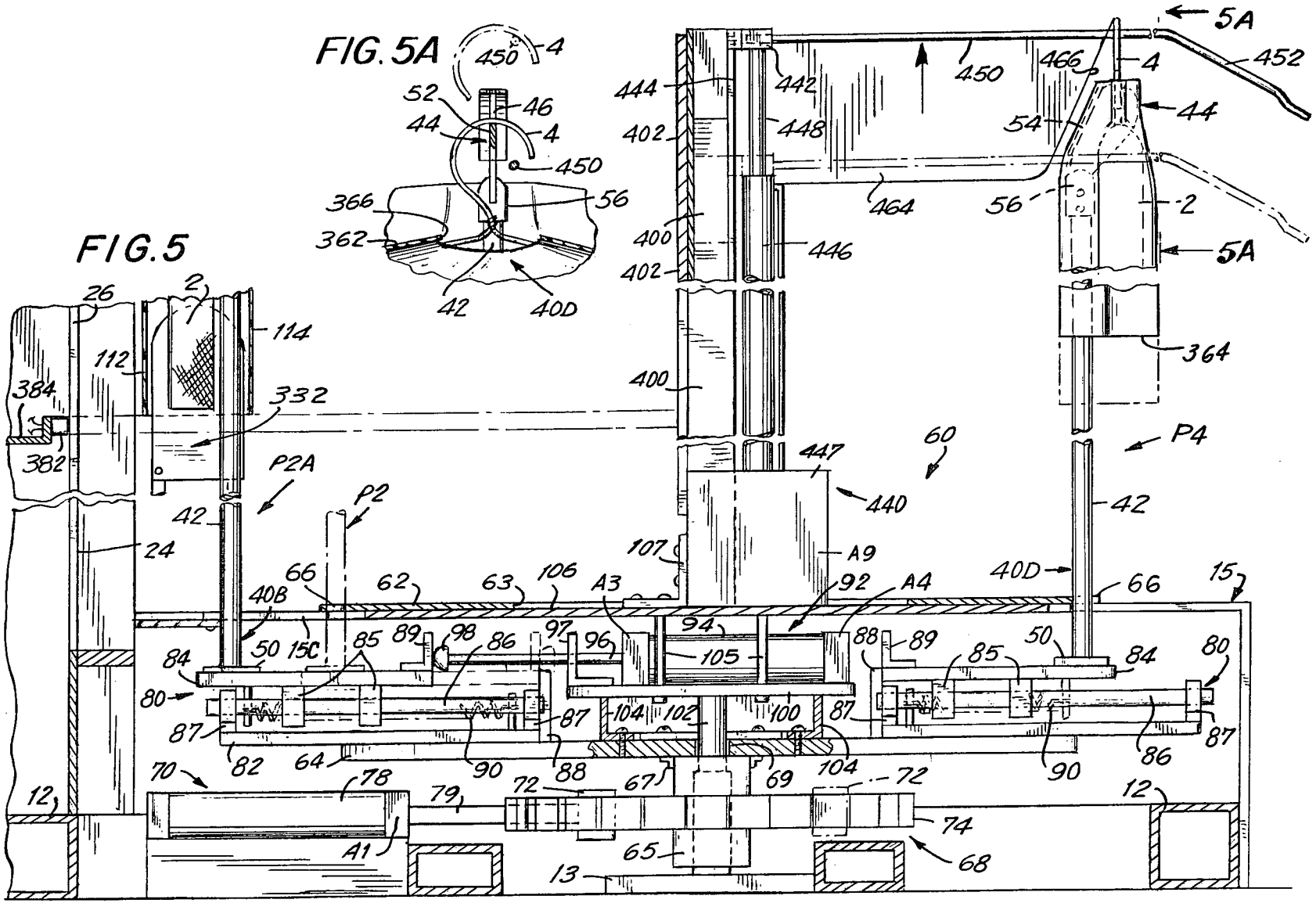
FIG. 5 is a cross-sectional view of the turntable and related components of the apparatus, taken along the line 5—5 of FIG. 1.
FIG. 5A is a cross sectional view showing the relationship of the garment hanger, the garment stand and the garment hanger arm, taken along the line 5A—5A of FIG. 5.
Figure 6:
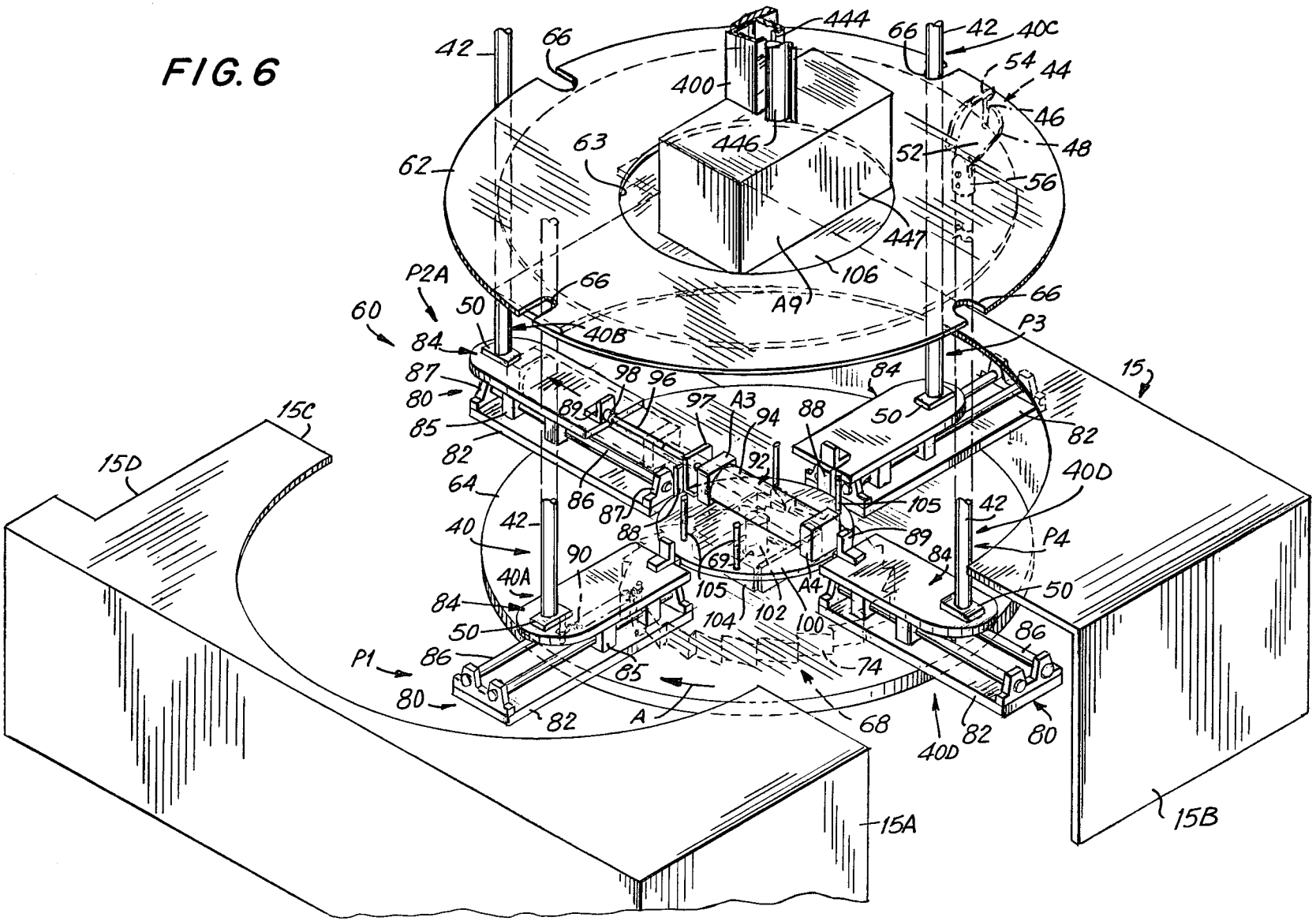
FIG. 6 is an additional, exploded view of the turntable assembly.
Figures 7, 8:
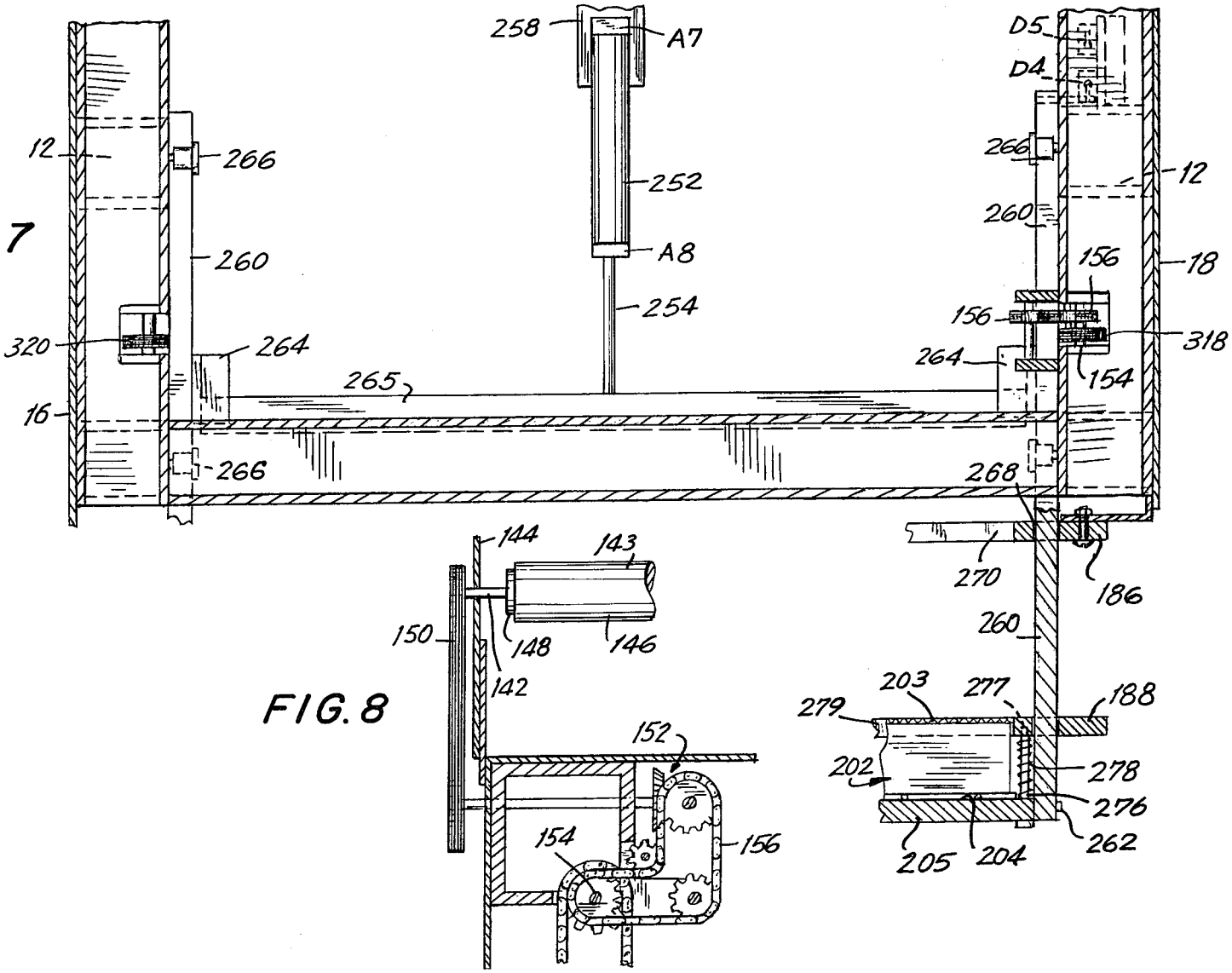
FIG. 7 is a sectional view of the apparatus, taken along the line 7—7 of FIG. 3.
FIG. 8 is a detail sectional view taken along the line 8—8 of FIG. 3.
Figure 9:
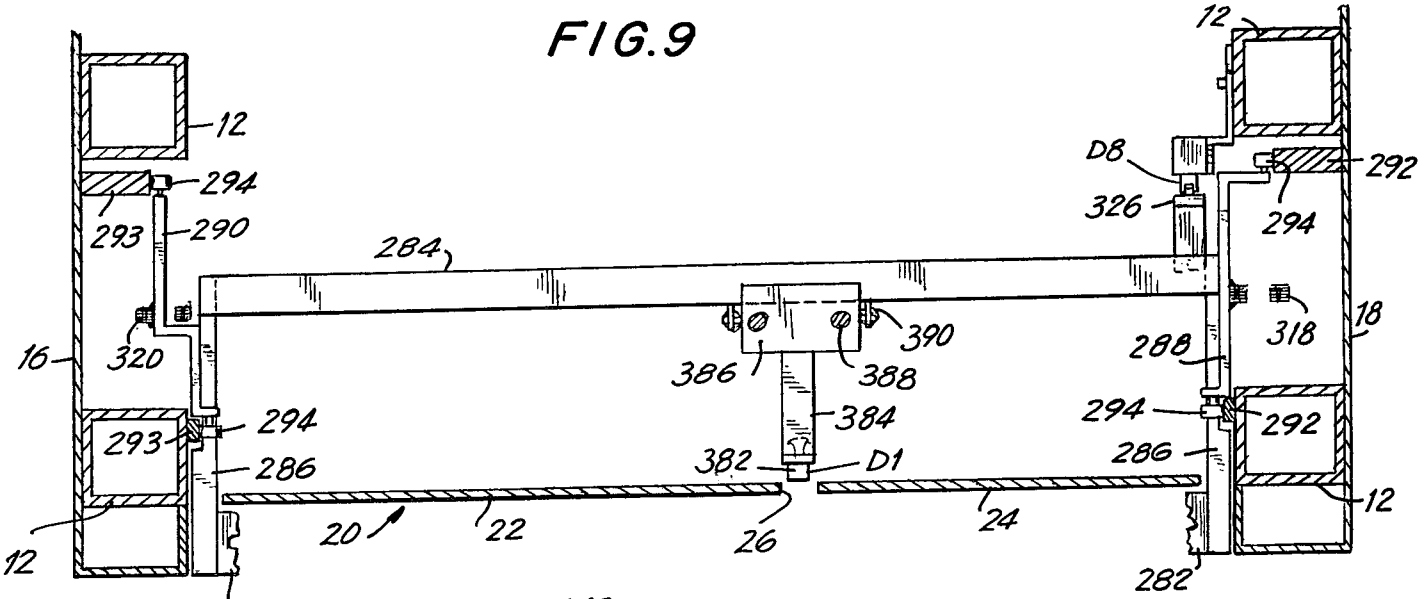
FIG. 9 is a detailed sectional view of the sensing means and related components, taken along the line 9—9 of FIG. 3.

Referring now primarily to FIGS. 2, 5 and 6, a turntable assembly is provided upon which a number, and desirably four, garment stands 40A, 40B, 40C and 40D are fixed. Each garment stand 40 includes an upright 42 (see FIG. 5), a hanger retention member 44 at its upper end and a bracket 50 at its lower end rigidly mounting the upright 42 on the turntable assembly. Each retention member 44 includes an upwardly slanting plate 52 having a broad face 48 and having a mouth 46 formed at its uppermost portion. The plate 52 has a slanted guard plate 54, whose function is later to be described. The plate 52 is joined to the upper end of the upright 42 by a sleeve 56. Although only one of the garment stands has been described in detail, they are all identical. As can be seen from FIGS. 2, 3, 4 and 6, the hook section of a conventional hanger 4 fits into the mouth 46 of the hanger retention member 44, with the garment 2 hanging from the hanger downwardly. Since the hanger retention member 44 is slanted, it holds the garment 2 hanging from the hanger 4 somewhat away from the upright 42. Further, the garment stands 40 are each oriented so that the plate 52 at its upper end is in a plane running along a radius of the turntable hereinafter described, whereupon the stands hold their respective garments face outwardly of the turntable, as seen in FIG. 4.

The apparatus 10 includes a turntable assembly 60, best seen in FIGS. 5 and 6, which enables garments on the stands to rotate through various positions. The turntable assembly 60 includes an upper turntable 62 having a central opening 63 and a lower turntable 64 having a central opening 69. A hollow shaft 65 is joined to the lower turntable 64 at bracket 67. The upper turntable 62 and the lower turntable 64 are joined for mutual rotation as hereinafter described. The upper turntable 62 has a number of slots 66, with each upright 42 of a garment stand 40 passing through one slot.

A turntable drive 68 is provided for rotating the turntable assembly 60. The drive 68 includes a ratchet wheel 74 carried by the hollow shaft 65 and a conventional one-way pawl 72. The pawl is reciprocated by indexing means 70, which includes a drive cylinder 78 and a pawl shaft 79. The cylinder 78 is air actuated and is controlled by an indexing actuator A1. The indexing means, when actuated as explained hereinafter, operates the cylinder 78 so that the pawl shaft 79 reciprocates and drives the wheel 74 to an extent such that the turntables 62, 64 rotate through an arc of 90° in a clockwise direction as indicated by arrow A in FIG. 6.

Each garment stand 40 is mounted upon a slide assembly 80, best seen in FIGS. 5 and 6, each slide assembly enabling movement of the garment stand which it carries to a limited extent along a radius of the turntable assembly. Each slide assembly 80 is identical and therefore only one need be described. Each such assembly includes a slide base 82 which is fixed to the lower turntable 64, with the four slide bases 82 being mounted 90° apart. Each slide assembly 80 further includes a slide 84 from which depend a pair of spaced journals 85. The journals slide along a pair of parallel rods 86 which are supported at their ends by brackets 87 on the base 82. Each slide 84 is biased toward a retracted position, that is biased toward a location central of the turntable assembly 60, by springs 90. A stop 88 at the innermost end of the base 82 limits inward movement of the slide 84. A projection 89 is fixed to the innermost end of each plate 84. The lowermost end of each garment stand 40 is fixed to the slide 84 by the bracket 50.

The upper turntable 62 is rotated with the lower turntable 64 due to the fact that the uprights 42 pass through the slots 66 in turntable 62, so that as the lower turntable 64 rotates, the slide assemblies 80 rotate, in turn rotating the uprights 42, which in turn rotates the upper turntable 62.

A central pole 400 shown in FIGS. 5 and 6 is fixed at its lower end to a central plate 106 by a bracket 107 and the upper turntable 62 rests upon plate 106. The outermost edge of the upper turntable 62 rests on the turntable housing 15. The central pole 400 is fixed and is supported from the top of the apparatus, as later explained.

The indexing means 70, as previously described, serves to intermittently drive the turntable assembly 60 through 90° arcs. The location of garment stand 40A as seen in FIGS. 1, 2, 5 and 6 may be described as a loading station or position P1. When the turntable assembly is now rotated 90°, the stand at the loading station P1 is brought to an operative station or position P2. Upon the next rotation of 90°, the stand at position P2 moves to an intermediate position P3, which is another 90° removed, and finally an additional 90° of arcuate movement brings the garment stand to its unloading station or position P4. It will of course be understood that each garment stand in turn rotates from position P1 through positions P2 and P3, to finally P4, and then returns to its initial position P1.

After the garment stand 40A at loading position P1 is rotated through a 90° arc and arrives at its operative position P2, this arrival is detected by detectors D2, D3, which are preferably microswitches shown schematically in FIG. 18, operated by cams, not shown, on the lower turntable plate 64.

Means are provided to reciprocate the slide assembly 80. When a garment stand is in the operative position, it is shifted into an alignment position P2A, see FIGS. 4 and 5, hereinafter described, by a slide drive assembly 92. The assembly includes a mounting plate 100 which is maintained in a fixed position by a central non-rotating shaft 102 which passes through the central aperture 69 in the lower turntable 64 internally of the hollow shaft 65 and is held by base 13. The assembly 92 further includes an air driven cylinder 94 from which a drive rod 96 projects, the drive rod passing through a bracket 97 on the plate 100 and terminating in a head 98. The mounting plate 100 is maintained above the lower turntable 64 by brackets 104. Upright guide rods 105 interconnect plate 100 to central plate 106 for mutual support.

As best seen in FIGS. 5 and 6, the slide drive assembly 92 operates upon each slide assembly 80 by the drive head 98 being aligned with and bearing upon the projection 89 on the plate 84. Since there are four substantially identical slide assemblies 80, each slide assembly 80 is operated upon by the drive assembly 92, as a garment stand 40 is carried by a slide 84 and moves into the operative position P2. The movement of the drive rod 96 within the cylinder 94 is controlled by actuators A3 and A4. When these actuators are operated so as to cause the drive rod 96 to extend, it in turn bears upon the projection 89, causing movement of the projection 89 and the slide 84 along a radius of the turntable so that the garment on the stand 40B at the operative position P2 shown in dot and dash lines in FIG. 5, is urged into the aligned position P2A shown in solid lines in FIG. 5. When the drive rod 96 is retracted by virtue of the actuators A3, A4, the slide 84 is returned to its initial position by the springs 90.

As best seen in FIGS. 2, 3 and 4, the apparatus 10 operates with a supply roll 110 of conventional and well-known tubular plastic transparent material. While rolled in the form of a supply roll 110, the tubular material is in the form of a flattened single plane web 111 but after the movement of this web through the apparatus, it will be seen that the web has opposed generally parallel broad faces, back face 112 and front face 114, and a pair of opposed generally parallel sides, right side 116 and left side 118. The supply roll 110 rides upon a supply roll shaft 120 which is held by a pair of spaced brackets 122 fixed to a rear portion of the frame 12.

As the supply roll unrolls, as later described, and as the web 111 continues to move through the apparatus, it is guided in its path of movement by conventional guide rolls 124, 126 and 128, all of these guide rolls being mounted by various supports attached to the frame 12.

Auxiliary drive means 140 is provided to aid in unrolling web 111 from the roll 110. This means includes an auxiliary drive shaft 142 carrying a roll 143, and journeled on a pair of brackets 144 fixed to the frame 12. The roll 143 is disposed transversely of the direction of movement of the web 111, and has an adherent surface 146, made up of polyurethane.

The roll 143 is driven in one direction only, this being the direction of movement of the web 111, shown by the arrow B in FIG. 18. The roll 143 is connected via a one-way clutch 148 to a drive chain 150, which in turn is driven by a series of gears 152 and another chain belt 156 from output shaft 154. The drive for output shaft 154 will be later described.

Means are provided to open the web 111 so as to separate the front face 114 from the back face 112 so as to create a generally rectangular mouth or opening, and to thereafter prevent the faces 112, 114 from returning to a contacting position. The separating means hereinafter set forth substantially reduces the static electrical charge in the web, whereupon the faces 112, 114 may be readily maintained apart.

The separating means includes a series of spherical balls 160 which are maintained in relative position by a cage 161, seen in FIGS. 3 and 4. The spherical balls are of relatively large diameter, and each comprises, in a preferred form, a hollow plastic shell punctuated by a series of apertures 162.

The balls 160 are held by the cage 161 which includes a pair of upper guide bars 164, 166 and a pair of lower guide bars 168, 170, held by a pair of brackets 172 on the frame. The upper guide bars 164, 166 are spaced from the lower guide bars 168, 170 by a distance substantially the same as but slightly more than the diameter of the balls 160. The balls 160 rest upon the lower guide bars 168, 170, are restrained from undue upward movement by the upper guide bars 164, 166, and are restrained in their side to side movement by their contact with one another.

The series of spherical balls 160 are located within a substantially rectangular opening of the web, that is, the opening defined by the front and back faces 114, 112, and by the sides of the web, 116, 118. As best seen in FIGS. 3 and 4, the web passes inside of both the upper guide bars 164, 166, and the lower guide bars 168, 170, but externally of the series of spherical balls 160.

The front and back faces of the web, 114, 112 are maintained in their open, separated position by a pair of vacuum chambers 178, 180 maintained under low pressure from a vacuum supply, not shown, to which they are connected by tubes 184. Vacuum chamber 180 is formed in a rear plate 186 and vacuum chamber 178 is formed in a front plate 188. Both the front and rear plates 188, 186, have a line of vacuum apertures 190 therein, these lines of apertures 190 being situated at the upper portions of plates 186, 188 and extending essentially the lengths of the faces of the web 111, with the vacuum chamber 180 operating upon the back face 112 of the web and the vacuum chamber 178 operating upon the front face 114 of the web, thereby to keep the faces apart, after the web has passed by the separating means including the spherical balls, as previously described.

A cutting and sealing assembly 200 is situated along the path of the web, as seen in FIGS. 3 and 4 below the balls 160. The assembly 200 comprises both cutting means and sealing means. The cutting means includes an elongated cutting blade 202 which terminates in a series of saw blade teeth 203. The blade 202 has a length somewhat greater than the width of either of the faces 112, 114 of the web. The blade 202 is supported on a carrier plate 205 by a bracket 204.

The carrier plate 205 is mounted for reciprocal movement towards and away from the rear plate 186. The carrier plate 205 is driven by carrier plate drive means 250, which includes an air actuated cylinder 252 from which a drive rod 254 projects. The cylinder 252 is mounted on the frame 12 by a bracket 256 which carries a plate 258.

The carrier plate 205 is mounted for reciprocal movement by a pair of opposed guide rails 260, the rails being attached on their forward ends by screws 262 to the carrier plate 205, and being fixed at their mid-portions by brackets 264 to a cross angle bar 265 to the drive rod 254. The movement of the guide rails is determined by a number of guide wheels 266 mounted on the frame 12 and the rear plate 186 has a pair of openings 268 through which the guide rails 260 pass. The same plate 186 has an elongated cutting opening 270 therein, through which the cutting blade 202 passes, when the carrier plate 205 is reciprocated. Actuation of the cylinder 252 is controlled by actuators A7, A8, which are connected to the controller means, as hereinafter described. One of the guide rails 260 carries a pin 261, which operates detectors D4, D5, which when operated, transmit signals to the controller means, hereinafter described. Specifically when the pin 261 on guide rail 260 moves from the right to the left in FIG. 3, it first passes microswitch D4 without operating it and then contacts microswitch D5 and operates it; then the pin reciprocates, passing D5 without operating on it and operating microswitch D4 when it reaches it. These are both hinged-type microswitches which are known in the art.

Presser means are provided to temporarily compress the web together, at the time that the cutting means operates. To this end, the lower portion of the front plate 188 carries a pressure pad 274. The front plate 188 as a whole is spring mounted on the carrier plate 205. A pair of rods 276 project inwardly from the plate 205, and thread, at their innermost ends, into bores 277 in the front plate 188. Coil springs 278 surround these rods 276 and serve to bias the front plate 188 away from and internally of the carrier plate 205. The front plate 188 also has an opening 279 therein, permitting passage of the cutting blade 202.

When the carrier plate 205 is driven by the carrier plate drive means 250 towards the rear plate 186, with the web 111 being located between the front and rear plates 188, 186, first the pressure pad 274 on plate 188 will contact an opposed portion of the rear plate 186, thereupon initially pressing and squeezing the web 111. Simultaneously with this movement, the vacuum 178 in the upper portion of the front plate 188 moves towards the vacuum chamber 180 in the upper portion of the rear plate 186, thereby also bringing the portions of the web between these vacuum chambers together. Continued movement of the carrier plate 205 by the carrier drive means 250 will move the cutting blade 202 so that the blade severs the web, the blade in its movement passing completely through the opening 279 of the front plate 188 and then at least partially through the opening 270 in the rear plate 186.

It should be noted that the plates 186, 188 in their most distant position are shown in FIG. 3 and are shown in their contacting position in FIG. 4.

Substantially at the same time that the aforesaid severence of the web is effectuated, the web is also heat-sealed, so as to form a heat seal line immediately below the line of severence. To this end, the rear plate 186 carries a non-stick surface 206, which is desirably made of Teflon. This surface 206 covers an opening 207 in the rear plate 186. The non-stick surface 206 is heated by heating means, which includes a transversely elongated heater element 208 which is electrically powered, seen in FIGS. 3 and 4. The heater element 208 is carried by a support 210. As best seen in FIG. 18, the heater element 208 comprises a pair of opposed sections 208A, 208B separated by a segment 208C at which no heater element is present and at which therefore no heat is applied. The gap 208C causes no sealing in a small central segment 366 of the upper portion 362 of a garment bag 360 thereby leaving a through passage at this location of the bag, through which the hook of a hanger may freely pass, see FIG. 5A. Drive means is provided to reciprocate the heater element 208. The drive means includes an air actuated cylinder 212 from which a drive rod 214 projects. The cylinder 212 is carried by a plate 215 held by a bracket 213 attached to the frame 12. The actuation of the cylinder 212 is controlled by actuators A10, A11.

When the carrier plate 205 is driven so as to press and sever a web which is located between rear and front plates 186, 188, the cylinder 212 is also operated so that the heater element 208 is driven toward and into contact with the interior face of the non-stick surface 206. This takes place at the same time that the pressure pad 274 presses the web against the exterior face of the non-stick surface 206. The heater element 208 is guided in its movement by a pair of journals 216 attached to the ends of the heater element 208. The journals slide on a pair of rods 218 fixed to the frame by brackets 220, see FIG. 18. The heating element 208 is maintained in its position against the non-stick surface 206 for a period of time sufficient at least to melt the web at this location causing adherence of the front face 114 to the back face 112 of the web, so as to seal a transverse, interrupted area of the web. The cylinder is actuated via actuators A10, A11, as hereinafter described.

Gripper means, seen in FIGS. 3, 13 and 14, are provided to draw the lowermost or leading edge 364 of the web 111 from a location between the plates 186, 188 to a position covering a garment.

The gripper means is carried by elevator means, generally 280, as seen in FIGS. 3, 9, 13 and 14. The elevator means includes a front cross piece 282 which extends in front of the front wall panels 22, 24, a generally parallel rear cross piece 284, and a pair of connector brackets 286. The elevator includes a pair of opposed carriages, namely a left side carriage 288 and an opposed right side carriage 290. Each carriage 288, 290, is fixed to one of the brackets 286. Further, each carriage mounts a set of four guide wheels 294 which run along vertically elongated guide rails on the frame, there being a set of guide rails 292 associated with the carriage 288 and a set of guide rails 292 associated with the carriage 290.

Elevator drive means is provided to reciprocate the elevator means 280. Said elevator drive means in includes a motor 300 which leads into a gear box 304. The box 304 has a pair of drive pulleys 306, 308, which are arranged to drive in the same direction, see FIG. 18.

From these pulleys 306, 308, an elongated chain drive made up of a series of chain drive elements, leads to the carriages 288, 290. Specifically, each of the pulleys 306, 308, drives a chain drive element 310, 312, which in turn drive intermediate shafts 314, 316 which in turn drive elongated chain drive elements 318, 320. These elongated chain drive elements 318, 320 pass over guide pulleys 322, 324, located above the upper ends of the rails 292, 293, respectively. Guide pulley 322 is mounted on drive shaft 154, which carries the auxiliary drive means 140. The left and right carriages 288, 290 are joined to the chain elements 318, 320, respectively, on opposite reaches, so that when the elements 318, 320, are driven, the carriages 288, 290 either elevate or descend. The motor 300 is energized by actuators A5, A6, which cause the shaft 302 to rotate either clockwise or counterclockwise, causing either ascending or descending movement of the carriages 288, 290, as determined by the controller means hereinafter set forth.

The rear cross piece 284 carries a cam plate 326 which operates upon detectors D8 and D6, on frame 12, which in turn give appropriate signals to the controller means for reasons hereinafter set forth.

The gripping means, carried by the elevator means, comprises a pair of gripping claws, seen in FIGS. 3, 13 and 14, namely a left side gripping claw 332 and a right side gripping claw 333. Each gripping claw is intended to grip a side of the web 111 when the web is in open position, with the left side gripping claw 332 intended to grip the left side 118 of the web and the right side gripping claw 333 intended to grip the right side of the web 116. Each gripping claw includes an interior movable jaw 334 on which is mounted a pressure pad 338 and an exterior fixed jaw 336. The pads 338 are provided to grip a side of the web with increased friction. The lower ends of the jaws 334, 336 are mounted for relative pivotal movement. The lower end of jaw 334 has a hinge 335 which rotates on shaft 337 held by block 339. Block 339 is mounted on rods 345 carried by an arm 347 attached to the front cross piece 282.

The interior jaw 334 is driven towards or away from the exterior jaw 336 by an air actuated cylinder 344, to which air under pressure is supplied by supply tubes 350 running from manifolds 352, to which air under pressure is supplied. The actuation of the cylinder 344 is controlled by actuator A2, which is connected to the controller system hereinafter described.

The apparatus 10 makes provision for operation on webs 111 of different widths. To this end, the distance between the gripping claws 332, 333 is adjustable. The front cross piece 282 has a pair of aligned, spaced slots 354, 356 formed therein. Each arm 347 on its interior end is connected by bolts 351 to a top plate 353. Arm 347 abuts on the lower face of the cross piece 282 and the top plate 353 abuts the upper face of the cross piece 282, the plate and the arm being rigidly connected by the bolts 351. When it is desired to move the gripping claws 332, 333, either further apart or closer together, the bolts 351 are loosened so that the arms 347 can be slid either closer or further apart. When they have been placed in their proper desired locations, the bolts 351 are again tightened. The aforesaid adjustment is made so as to locate the jaws 332, 333 in alignment directly under the sides of the web, when the web is in its open condition.

Sensing means to determine the presence of a garment at the operative position P2 as well as to determine the position of the lowermost edge 8 of a garment is also provided. The sensing means includes a photocell assembly 382, see FIGS. 3, 9 and 15, which includes both a light emitting unit and a light detecting unit. The photocell 382 is mounted on a bracket 384 attached as hereinafter described to rear cross piece or bar 284.

The sensing means also includes a vertically elongated reflecting surface 402, see FIGS. 3, 4, 5 and 18, which is oriented so as to face the photocell 382. The reflecting surface 402 is mounted on the central pole 400, which is held by a pair of brackets 404 to the wall 19 of the housing. Further, the reflecting surface 402 is in alignment with the vertical slot 26 between the front panels 22, 24, with the photocell 382 also being oriented so that light from its light source passes through this slot.

The photocell bracket 384 holds the photocell 382 normally at a level such that light from the light source within the photocell 382, projected towards the surface 402, is intercepted by a garment 2 on a garment stand 40B at the operative position, as shown in FIG. 17. On the other hand, it there is no garment 2 on the stand 40B which is at the operative position P2, the light from the photocell 382 will strike the reflective surface 402, and be bounced back to the light detecting unit within the photocell 382, as shown in FIG. 16, thereby sending an appropriate signal to the controller means, as hereinafter set forth. The photocell 382 operates as detector D1. It will be appreciated that when the cross piece or bar 284 ascends or descends, it carries the photocell 382 with it in either direction.

A floating relationship is maintained between the photocell 382 and the cross bar 284, for reasons hereinafter set forth. To this end, the cross bar 284 fixedly carries a central mounting block 386 and a pair of parallel rods 388 slide through this block. The rods at their lower ends are interconnected by end block 385, and at their upper ends are connected by end block 387. Thereby, the end block 385 and therefore the photocell 382 may move upwardly or downwardly to a limited extent with respect to the cross bar 284. Springs 390 bias the end block 385 and thus the photocell 382 relatively upwardly and relatively closer to the cross piece 284. The frame carries a stop 392, see FIGS. 3 and 15, which is contacted by the upper block 387, when the cross bar 284 moves upwardly.

As the cross bar 284 moves upwardly, the stop 392 is contacted by the upper block 387, preventing further upward movement of the upper block 387 and therefore preventing further upward movement of the photocell 382. As the cross bar 284 continues to more upward, the photocell 382 continues to be spaced more distantly from it, as it can no longer travel.

When the cross bar 284 then begins to descend, initially there is no movement of the upper block 385, until a point at which the central block 386 contacts the lower block 385. When this contact has taken place, both the block 385 and the block 386, and therefore the photocell 382, and the cross piece 284 move in unison.

The floating relationship between photocell 382 and the cross bar 284 is provided so that the photocell may initially detect the presence of a garment 2 on garment stand 40B at the loading station P2, and after such detection has taken place, so that the photocell may move downwardly in unison and below the gripping claws 332, 333. When the photocell has detected the lower edge of the garment, the claws will have thus pulled a sufficient amount of web 111 over the garment to size the garment bag to the garment length.

As indicated most clearly in FIG. 3, when upper block 387 hits stop 392, the photocell 382 is maintained in a position allowing it to detect the presence of garment 2 near the upper edge 6 of the garment. In this position, the photocell 382 is maintained at a position more distant from the gripping claws 332 and 333, the latter being supported by the front cross bar 282 in a position such that the claws are above the hanger retention member 44 and between the cutting and sealing assembly 200.

The floating arrangement thus enable the photocell and gripping claws to be initially in a distant position, wherein the claws are approximately 12–14 inches above the cell. After the claws have been moved downwardly an amount, the photocell and claws move downwardly in unison, with the photocell and claws in an adjacent position wherein the claws are above the photocell by approximately 6–8 inches.

Thus, when the photocell 382 detects the presence of a garment at the loading position P2, the stand is moved to its aligned position P2A, the jaws of gripping claws close to grab the sides 116, 118 of the web and the front and back cross bars 282 and 284 start to moe downwardly so that the web can be pulled over the garment. Prior to this movement, the photocell and claws are in their distant position, i.e., separated by 12–14 inches. The photocell 382 initially stays in the position shown in FIG. 3. Continued downward movement of the cross bars causes the central block 386 to contact the lower block 385. At this point, the gripping claws 332, 333 have been moved to the adjacent position relative to the photocell. Further downward movement of the cross bars causes the photocell 382 and the gripping claws 332, 333 to move together, with the photocell and gripping claws in this adjacent position, i.e., separated by approximately 6–8 inches.

Garment displacement or transferring means are shown in FIGS. 2 and 5. Said means operate on a garment stand 40D which is located at unloading position P4. Said means includes an air actuated cylinder 446 from which a rod 448 extends upwardly. The clyinder is fixed at its bottom end to cylinder block 447 which in turn is carried on central plate 106. The cylinder rod 448 at its uppermost end terminates in a rod block 442 which rides in a vertically elongated channel 444 formed in central pole 400. The air cylinder 446 is controlled by actuator A9. The upper end of cylinder rod 448, at block 442, has attached a vertically elongated hanger arm 450, the outer end 452 of which is sloped downwardly. Hanger arm 450 is normally at a level shown in solid line in FIG. 5A. When the stand 40D moves to the unloading position, the hanger retention member 44 at the upper end of the garment stand 40D holds the hanger 4 such that the hook of the hanger is somewhat above and aligned with the arm 450, with the hanger hook being within the mouth 46 of the hanger retention member 44. When the cylinder 446 is actuated, the rod 448 extends, carrying the support arm 450 upwardly so that the arm catches the hook of the hanger, removes it from the mouth 46 of the hanger retention member 44, and carries it upwardly as indicated in dot and dash lines of FIG. 5A.

Displacement members move the hanger 4 from the support arm 450 to a slide 442, shown in FIG. 2 and thereafter to a garment rack 420, of a conventional type. The displacement members comprise a pair of triangular shaped plates 464 attached by bolts to the upper end of the central pole 400. The plates 464 are spaced apart so that the support arm 450 may pass between them, but are close enough so that they will act upon the hook portion of the hanger 4. The plates have elongated camming edges 466, which run from a lower portion of the pole 400 outwardly, so as to terminate at an entry end 424 of the slide 422. From this entry end 424, the slide 422 descends somewhat gently downwardly toward toward an exit end 426. The slide 422 is supported by uprights 428.

After the hanger arm 450 has picked up a hanger, as shown in dot and dash lines in FIG. 5A, and in solid lines in FIG. 5, it is elevated until the upper surface of the hanger hook contacts the camming edges 466 of at least one and perhaps both of plates 464. Further upward movement of the hanger arm 450 causes the edges 466 to act upon and cam the hook of the hanger 4 outwardly so that the hanger hook moves along the hanger arm 450 and then moves on to the hanger arm end 452, after which the hanger moves downwardly by gravity. As best seen in FIG. 12, as the end 452 of the support arm 450 continues to move upwardly, it engages a U-shaped bridge 468 extending from the entry end 424 of the slide. As the hanger hook descends down the end 452, it moves onto the bridge 468 and thereafter on to the entry end 424 of the slide 422. The hanger hook then continues the downward movement along the length of the slide 422 until it reaches the exit end 426 of the slide, whereupon it moves onto the garment rack 420.

Having now described the mechanical components of automatic bagging apparatus 10, its operation will be generally outlined, it being understood that the overall cycle will be described in greater detail when controller 28 (FIGS. 10 – 22) is considered below.

A garment 2, carried by a hanger 4, is placed on the hanger retention member 44 of a garment stand 40 located at the loading position P1. The garment may be placed at the loading position by appropriate apparatus (not shown), or even by hand.

The controller 28 energizes actuator A1 to cause the stand with the garment at the loading position P1 to move to the operative position P2. The stand 40 is moved from the loading position P1 to the operative position P2 through an arc of 90 degrees by the indexing means 70 and, specifically, by drive cylinder 78 which rotates the ratchet whel 74 via one way pawl 72 and pawl shaft 79. This causes rotation of the lower turntable in the clockwise direction, indicated by the arrow A in FIG. 6.

Before the turntable rotates the full 90 degrees, the presence of the garment near the operative position P2 is sensed, since the garment will interrupt the light path between photocell 382 and the reflecting surface 402. This interruption is detected by detector D1. Since this interruption of the light path occurs when the outer edge of the garment breaks the path, i.e., near the garment shoulder and before the turntable has indexed its full 90 degrees, the turntable continues to rotate in the clockwise direction without any other operations commencing. The completion of the indexing is sensed by detector D2. The condition of the apparatus at this stage is shown in FIG. 3.

The controller then causes actuator A3 to operate, resulting in movement of the slide assembly 80. The slide assembly moves the drive rod 96 from right to left, as seen in FIG. 5, and the drive head 98 pushes the slide 84 against the action of the biasing springs 90. As a result, the stand 40 is moved from the operative position P2 to the aligned position P2A, as seen in FIGS. 4 and 5. In this aligned position, the garment is located on the stand 40 beneath the path of web 111.

With the stand at the aligned position, the jaws 334, 336 of the left gripping claw 332 and the right gripping claw 333 close. The controller causes actuator A2 to operate the cylinders 344 in a manner to pivot the interior jaws 334 so that the sides of the web are gripped by the jaws.

With the left gripping claw 332 engaging the left side 118 of the web and the right gripping claw 333 engaging the right side 116 of the web, the controller energizes actuator A5. This causes motor 300 to operate in a direction to lower the grippers. Motor 300 is driven in a manner whereby chains 318, 320 are rotated in the direction which causes carriages 288, 290 of the elevator means 280 to move downward. As the elevator means is lowered, the gripping claws pull the web 111 downwardly over the garment. The slanted guard plate 54 on the hanger retention member 44 insures that the front face 114 of web 111 is not torn by the retention member as the web is pulled over the stand.

The web may be easily pulled over the garment since the faces 112, 114 and sides 116, 118 of the web are limp. As indicated in copending application Ser. No. 721,957, filed in the name of Vincent N. Vulcano and Maurice W. Friedman for Semi-Automatic Bagging Machine, filed concurrently herewith, this is the result of the action of the spheres 160 which by some manner not fully understood, break up the forces which would normally cause the faces and sides of the web to stick or be attracted together.

Actuation of the chain 318 in a direction to lower the elevator means also transmits movement to the auxiliary drive means 140 located near the top of the apparatus. This causes the drive shaft 142 to rotate in the direction indicated by arrow B, as seen in FIG. 3. Since tension is being applied to the web 111 as the result of the downward pulling action of the gripping claws, the web is pulled against the adherent surface 146 of the auxiliary drive means enabling the auxiliary drive to assist in supplying the tubular material from the roll 110 located at the rear of the apparatus.

Initial downward movement of gripping claws 332 and 333 has no immediate effect on movement of the photocell 382. However, as the claws continue in their downward direction of movement, the rear cross bar 284 will cause the intermediate block 386 to act on the lower block 385. When this happens, the photocell 382 starts to move downwardly in unison with the rear cross bar 284; the photocell 382 and the gripping claws 332, 333 maintain their relative positions during the continued downward movement, with the photocell being slightly below the claws. The photocell detector 382 detects the bottom edge 8 of the garment in a manner whereby the claws pull down a length of material dependent upon the length of the garment. The lower edge of the material is still above the bottom of the garment; continued downward movement of the material occurs subsequently. The material is now held stationary so that it can be cut and sealed.

To this end, actuator A7 causes movement of the drive rod 254 of cylinder 252 in a direction from right to left, as viewed in FIG. 3, resulting in movement of the front or compressing plate 188 and the carrier plate 205 of the cutting and sealing assembly 200 in this same direction. The front plate 188 first makes contact with the rear plate 186 thereby compressing the front and rear faces 114, 112 of the web together. The carrier plate 205 continues to move in the right to left direction toward the rear plate 186 until the position is reached, shown in FIG. 4, wherein the knife blade 202 severs the web and the heating element 208 seals the two faces of the web together.

During the cut-and-seal sequence, the rails 260, carrying the front plate 188 and the carrier plate 205, move in the right to left direction, and pin 261 passes below detectors D4 and D5. Passage of pin 261 from right to left has no effect on detector D4, but as the pin passes beneath detector D5 in the right to left direction, this detector operates. Once detector D5 operates, acutator A10 causes cylinder 212 to move the piston rod 214 from left to right as viewed in FIG. 4, thereby bringing the heater element 208 in contact with the rear of the non-stick surface 206, so that when the plates 186, 188 and 205 of the cutting and sealing assembly are closed, the non-stick surface is heated to effect the seal. The position of the cutting and sealing assembly 200 at this time is indicated in FIG. 4.

After the cut has been made and the seal is in progress, the controller causes actuator A8 to move rails 260 in the opposite or left to right direction to open the cutting and sealing assembly. As the pin 261 on the rail 260 passes from left to right, it passes beneath detector D5 and then detector D4. The passage of the pin from left to right does not operate detector D5, but it does operate detector D4. When detector D4 operates, the controller causes actuator A11 to operate on the cylinder 212 to withdraw the heating element 208 from the rear face of the non-stick surface 206. As the plates 188, 205 move to the right, the front face 114 and the rear face 112 of the web are maintained apart above the cut line by the vacuum chambers 178, 180.

After the cutting and sealing means 200 has cut and sealed the web, the controller causes the gripping claws 332, 333 to move downwardly yet further, and the formed bag is pulled down until the seal line 362 rests on the upper edge 6 of the garment, enabling both the hanger hook and the hanger retention member 44 of the stand to pass through the hanger opening 366, as indicated in FIG. 5A. The controller then de-energizes actuator A2 to open the jaws of the gripping claws, so that the bottom edge 364 of the bag is released. It is to be noted that after the web is cut, further downward movement of the claws will not cause the auxiliary drive means 140 to supply additional material, since there is no tension on the web around adherent surface 146. The gripping claws continue to move downward slightly so that they clear the bottom of the formed bag.

The controller then causes actuator A4 to retract the drive rod 96 so that the slide 84 carrying the stand 40 moves under the influence of the springs 90 from left to right as seen in FIG. 5. The stand carrying the garment is thus moved from its aligned position P2A back to its operative position P2.

Motor 300 now rotates in a direction to raise the gripping claws, with the claws being raised until detector D6 is operated, indicating that the claws have reached the position between the now open plates of the cutting and sealing means. Motor 300 is operated in the reverse direction by energizing actuator A6 together with actuator A5. It should be noted that movement of the claws in the upward direction does not result in rotation of the auxiliary drive means due to the provision of one-way clutch 148, and also that no tension is being applied to the web to pull it against adherent surface 146.

After the garment stand has returned to its operative position P2, the controller indexes the garment stand to the intermediate position P3 and, assuming that another garment is now presented at the operative position, the cycle is repeated with the garment which is now at the operative position having the web pulled over it, when it is shifted to the aligned position. After this garment has been bagged, the turntable is rotated another 90 degrees so that the garment stand of the first or earlier bagged garment moves from the intermediate position P3 to the unloading position P4. At this position, the lifting assembly 440 operates on the first bagged garment to remove it from the stand and to transfer it to the storage area. Dectector D3 senses the completion of an indexing step and directly causes actuator A9 to move the hanger arm 450 upwardly, with the hanger arm engaging the hanger hook and carrying the hanger and bagged garment upwardly off the stand. The edges 466 of cam plates 464 also move the hanger in a path having a horizontal component so that the hanger slides along the arm 450 in a direction from left to right as viewed in FIG. 5. When the slopping end 452 of the hanger arm engages the entrance end 424 of slide 422, the hanger is transferred to the slide where it falls by gravity down the slide and on to the rack 420.

At the start of the next indexing step, actuator A9 de-energizes. The hanger arm returns to its lowermost position before the indexing is complete so that it is positioned underneath the top of the next hanger prior to the arrival of this hanger at position P4.

The controller itself (FIGS. 19 – 22) will now be described; in the course of this description, the individual steps in an overall cycle will become further apparent.

To start the machine, switch 28A on the panel is turned to the on position. At this time, the AC power line 868 is connected to power supply 870 (FIG. 21). The power supply furnishes the positive potentials shown in the remainder of the schematic drawing. Thereafter, switch 28B is momentarily depressed to cause the CLR conductor to go low. The low potential on this conductor is applied to the clear input of J-K flip-flop 842 (FIG. 19) to place it in the reset state, with the Q output going low and the Q output going high. The CLR conductor is also extended to an input of gate 810 (FIG. 20). Gate 810 generates the A5 signal which, as will be described below, controls operation of the motor 860 (FIG. 21) which moves the grippers; this is the same motor indicated by reference numberal 300 in FIGS. 1–18. During start-up, gate 810 is disabled by the CLR pulse to insure that the motor does not operate.

The Q output of flip-flop 842 is connected to conductor ONHK. When this conductor is high in potential, as will be described below, the overall cycle is near its end and motor 860 moves the grippers upwardly. (During this description, reference to "grippers" refers to the gripping claws 332, 333 previously described). Consequently, after switch 28B is released, because flip-flop 842 is reset the system starts operating at a point toward the end of the cycle at which time the motor is operated such that the grippers move up toward the starting position if they are not already there.

The high potential on conductor ONHK is extended to the E input of read-only-memory 800. Since the ONHK conductor is initially high, the memory is not enabled. The memory is provided with tri-state outputs, each output being either a 0 or a 1 if a data word is being read from the memory when enabled, or each output being left floating if the memory is not enabled. The eight data bit outputs DB0 through DB7 are connected to respective conductors TRN, R, CG, SP, CO, CC, DE and M, as shown in FIG. 20, and consequently after flip-flop 842 is reset, the memory outputs do not affect the potentials of these conductors.

Instead, the potentials of these conductors are determined by the outputs of respective amplifiers 812-TRN through 812-M, these amplifiers having tri-state outputs as well. The high potential on the ONHK conductor enables each of these eight amplifiers following the generation of a reset pulse by switch 28B. Some of the inputs to the amplifiers are connected directly to ground, while the others are connected to the TOP conductor. This conductor is high in potential whenever the grippers are not in their uppermost position, as will be described below, to force conductors M, CO and R to a high state. With such a condition, as will be described below in connection with the terminal portion of an overall cycle, the grippers move upwardly to their topmost position. This sequence takes place when the machine is first started, following the resetting of flip-flop 842 by switch **28*b***.

The high potential on conductor ONHK also resets counters 802 and 804. It is only when the ONHK conductor goes low that both the counters and the memory are enabled, the counters having been reset preparatory to a start of the memory sequencing.

During a start sequence, following the operations of switches 28A and 28B, and after the grippers have returned to their uppermost position, switch 28C (FIG. 20) is momentarily operated. As will become apparent below, indexing of the turntable is automatic during normal operation, but when the first garment is placed on a stand at position P1 it is necessary to manually trigger an indexing step. When switch 28C is momentarily closed, the output of gate 816 goes high. The high potential on conductor A1 is extended to actuator A1 which is the indexing solenoid. The solenoid is operated and the turntable turns 90°. All that the turntable unit requires is a short positive pulse for triggering an indexing cycle. Thereafter, the indexing cycle is automatic, the turntable turning through an angle of 90°.

As the first garment moves in front of photocell detector D1 at position P2, the output of the detector (FIG. 19) goes high. The detector output is extended through inverters 834 and 836, so that as soon as the first garment is detected, one input to gate 838 goes high. Another input of gate 838 is connected to normally-closed switch D6. This switch is open only when the grippers are at the uppermost position, as they are before switch 28C is first operated. Thus when switch 28C is manually closed, a second input of gate 838 is high. The third gate input is connected to the BPOS conductor. Flip-flop 832 is a conventional "switch de-bouncer." The element is a flip-flop whose state changes when normally-closed contacts D2-NC open and when normally-open contacts D2-NO close. Detector D2 is an indexing switch whose contacts switch from the positions shown in FIG. 19 to the opposite positions at the end of each indexing cycle, when the turntable is at rest. Consequently, after the turntable has rotated 90° following the manual closing of switch 28C, the flip-flop is placed in a state such that the BPOS conductor goes high. (The switch de-bouncer 832 is used only to prevent alternations in the potential of the BPOS conductor for the several milliseconds following an indexing step as the contacts of switch D2 bounce, as is known in the art.) When conductor BPOS goes high, since all three inputs to gate 838 are high in potential the output of the gate goes high to enable the J input of flip-flop 842. The output of gate 854 is low at this time, although that is immaterial. The next negative step from 500-Hz clock 844 provided at the clock input of the flip-flop causes the flip-flop to set, so that the Q output goes high and the Q output goes low. Thereafter, the clock pulses have no effect on the state of the flip-flop until the K input goes high, as will be described below.

Gate 809 (FIG. 20) is normally held off; its output goes high only when actuators A2, A3 and A5 are operated together. Since the output of gate 809 is connected via conductor 826 to one input of gate 852, the output of this gate is high (since conductor 826 is low) to enable one input of gate 846.

When the Q output of the flip-flop 842 first goes high, the second input to gate 846 is enabled. The output of the gate now goes high to enable 65-Hz clock 848 which generates two clock signals $\phi 1$ and $\phi 2$, on conductors 828 and 830, having the relative phases as shown in FIG. 19. It is the $\phi 1$ clock pulses on conductor 828 which are applied to the count input of counter 802 to control the sequencing of the system as sequential addresses are applied to the address inputs of the memory and data words stored in successive locations are read out at output terminals DB0–DB7. Of course, in order for the counters to count and for the memory to be operated, the ONHK conductor must be low as described above. But since this conductor is connected to the Q output of flip-flop 842, it is apparent that the counters and the memory are enabled as soon as flip-flop 842 is set (the counters having first been reset when the ONHK conductor was high as described above). Successive negative steps of the $\phi 1$ clock pulses increment counter 802, each negative step in the carry output of this counter causing counter 804 to increment. The two counters together provide an address for accessing the memory. Amplifiers 812-TRN through 812-M are now disabled and their outputs remain floating so that the potentials extended to actuating conductors A1 through A8 are controlled by the data words read from the memory.

Initially, it is the low potential on conductor 826 which causes the output of gate 852 to go high so that when flip-flop 842 is set, gate 846 can enable clock 848. But since the three inputs to gate 809 (FIG. 20) are derived from the A2, A3 and A5 actuating signals, it is apparent that during subsequent sequencing, the potential on conductor 826 will go high when all three of the A2, A3 and A5 actuators are energized. It is therefore important to understand the manner in which gate 846 controls the enabling of clock 848.

Initially, conductor 826 is low in potential so that the output of gate 852 is high to enable one input of gate 846. As soon as flip-flop 842 is set, the other input to gate 846 goes high so that the clock starts to run. It is the running of the clock that controls successive incrementing of the input addresses to the memory and the sequencing of the machine at the beginning of each cycle. The potential of the BSENS conductor at the start of the cycle is of no moment since the state of the output of gate 850 does not affect the operation of gate 852; at the start of a cycle, it is the low potential on conductor 826 that causes the output of gate 852 to remain high.

The sequencing of the machine can be controlled by clock 848 with respect to those motions which require fixed time intervals for the performance of the respective functions. But there is one function whose time interval varies from cycle to cycle, and that is the function of the grippers moving down in order to "bag" the garment. The duration of the movement is a function of the length of the garment. It is for this reason that the sequencing during the actual "bagging" is not under control of clock 848. (Similar remarks apply to return of the grippers to the top of the apparatus at the end of the cycle.)

As will be described below, when the grippers are moving down, actuators A2, A3 and A5 are all energized, the three inputs to gate 809 are high, and conductor 826 is high in potential. The output of gate 852 is thus determined solely by the potential at the output of gate 850. At the start of the downward movement of the grippers, as will be described below, the DE output of the memory (data bit DB6) is high in potential and thus one input of gate 850 is high. Consequently, the output of the gate is determined solely by the potential of the BSENS conductor. When the grippers start to move downward, photocell detector D1 is adjacent a garment and its output is high. Consequently, the output of inverter 834, the BSENS conductor, is low and the output of gate 850 is high. With both inputs to gate 852 being high, its output goes low to disable clock 848. Consequently, the memory no longer sequences and the grippers continue to move downward. But as soon as the photocell moves underneath the garment, the BSENS conductor goes high in potential. With both inputs to gate 850 now being high, the output of gate 850 goes low, the output of gate 852 goes high and clock 848 is enabled once again. Consequently, the sequencing once more takes place under control of clock 848.

At the start of the cycle, counter 802 begins to increment. The two counters together generate an 8-bit address which continuously increases (except during the downward movement of the grippers when clock 848 is held off). FIG. 22 depicts the data words stored in the memory at each location. (In actual practice, a 256×8 ROM can be used, although less than 256 locations are required, as will be described below.) The data words depicted on FIG. 22 have their most significant bits first, that is , the leftmost bit of each word corresponds to data bit DB7 at the output of the memory, and the rightmost bit in each data word corresponds to data bit output DB0 at the output of the memory. When the first location (address 0) is accessed, the data word at the output consists of eight 0's. None of the actuators is energized. Similarly, the data words at addresses 1 through 9 are also all 0's and no operations take place when they are read out from the memory. (A data word consisting of all 0's is essentially a NO OP code.) It will be recalled that clock 848 starts to count after a complete indexing step has taken place, with the BPOS conductor (FIG. 19) going high. But at the end of a 90° turn of the turntable, the four stands may require a fraction of a second to stop vibrating. It is to allow the stands to stop vibrating that the machine waits for a fraction of a second before the various operations now to be described actually commence.

When counters 802 and 804 represent an address of 10 (decimal — all addresses herein are in decimal notation), the data word read out is 00000100. The only data output bit which goes high is DB2, connected to the CG ("close grippers") conductor. The CG conductor is connected to actuator conductor A2 which, when energized, causes actuator A2 to close the jaws of the grippers. Since the grippers are now at the top of the machine and they are around the edge of the plastic tubing at respective ends, when the jaws close they grip the plastic. The same data word is stored at addresses 10–19, so that ten clock cycles are used to allow the grippers to close around the edge of the plastic. (In general, a few clock cycles are used to operate each solenoid actuator individually; it is preferred practice to switch a limited number of solenoids simultaneously.)

When address 20 is reached, the data word read out is 00001100. Data bit DB2 is still a 1 since the grippers must be held closed around the plastic tubing. But starting with the read-out of the word at address 20, data bit DB3 is a 1 as well as data bit DB2. Data bit DB3 is connected to the SP ("stand push") conductor, which is connected to actuator signal conductor A3. This conductor is coupled to the solenoid actuator which controls pushing of the stand at position P2 out away from the center of the turntable toward the actual bagging mechanism, i.e., to the P2A align position. It should be noted that inverter 820 is connected between conductor A3 and conductor A4. It is over the latter conductor that a signal is extended for controlling withdrawal of the stand, in toward the center of the turntable. Conductors A3 and A4 always have opposite states. Consequently, whenever the stand is to be adjacent the bagging mechanism, data bit DB3 must be a 1, and whenever the stand is to be held retracted, data bit DB3 must be a 0.

The data words stored at addresses 21 through 29 are also all 00001100; this allows sufficient time as the data words are read out in succession for the stand at position P2 to be moved all the way forward to a position underneath the grippers, i.e., to P2A.

The data word at address 30 is 11001100. The DB2 and DB3 bits still control actuators A2 and A3; the grippers are still held closed by actuator A2 and the stand is still pushed outward by actuator A3. But now data bits DB6 and DB7 are also both 1's. Data bit DB6 is connected to the DE conductor, which, as described above, allows gate 850 to be controlled by the potential on the BSENS conductor. Initially, the BSENS conductor is low in potential since a garment is in front of the photocell. Thus the output of gate 850 remains high, even though its DE input is now high, to enable one input of gate 852. As will be described shortly, the DB7 1 bit causes conductor A5 to go high. With all three inputs to gate 809 being high, conductor 826 goes high to enable the other input of gate 852. Consequently the gate output goes low and the clock turns off.

The memory outputs which remain high are DB2, DB3, DB6 and DB7. The DB7 output is connected to the M ("motor") conductor for controlling downward motion of the grippers. Conductor M is connected to one input of gate 810. Another input to this gate is connected to the CLR conductor which is high during sequencing of the machine. The third input to gate 810 is connected to the output of gate 824. One input to this gate is the BLIM conductor which is normally low. A de-bounce switch 806, controlled by the limit detector D7 at the bottom of the machine, causes the conductor to remain low as long as normally-closed contacts D7-NC are closed and normally-open contacts D7-NO are open. It is only if the grippers are pulled down too far that detector D7 operates. Thus during normal operation conductor BLIM is low, and it is certainly low before the grippers have even started to move downward. Consequently, the low BLIM input to gate 824 holds the output high. With the third input to gate 810 being high, conductor A5 is energized.

The motor control circuit is shown in FIG. 21. The AC line 868 is coupled through on/off switch 28 A and solid-state relay 872 to the armature and field windings of motor 860, and the electromechanical motor brake. (Detector switch D9 is normally closed and switch 28 D is normally open, as will be described below.) Until solid-state relay 872 is operated, power is not extended through the relay to the various windings of the motor. But as soon as a signal appears on conductor A5, the relay circuit in the power line closes and power is extended to the motor windings. The direction in which the motor turns depends on whether relay 864 is energized, i.e., the position of its two contacts.

Initially, actuator signal A6 is low since data bit DB1 is a 0. Consequently, a positive potential is not extended through solid-state relay 862 to the winding of relay 864 and the relay contacts remain in the position shown in the drawing. In this position, the motor moves in a forward direction which drives the grippers downwardly. (It is only when actuating signal A6 is generated that relay 868 operates to move the contacts; at this time, the phase of the field winding is reversed relative to the phase of the armature winding, and the motor runs in the opposite direction to cause the grippers to rise.)

With the motor running in the forward direction, the grippers move downwardly; clock 848 is held off so that the input address to the memory does not advance. As soon as the photocell reaches the bottom of the garment, the BSENS conductor goes high in potential. With both inputs to gate 850 now being high, the output goes low. Consequently, the output of gate 852 goes high to enable one input of gate 846. Since flip-flop 842 is still set, the other input to the gate is also high; the gate output goes high, and clock 848 resumes running.

It will be recalled that when the photocell reaches the bottom of the garment, the grippers are still above the bottom of the garment. Consequently, there must still be controlled movement of the grippers in the downward direction by an amount approximately equal to the separation in the vertical dimension of the grippers and the photocell, i.e. 6 inches to 8 inches. Part of this movement now takes place. The last address represented by counters 802 and 804 was address 30, the data word maintained at the output of the memory having resulted in the actuation of actuators A2, A3 and A5, and the energization of the DE conductor. As the clock continues to cycle, the locations accessed have successively increasing addresses 31 through 33; the data word 11001100 is stored in these locations as well as at address 30. Consequently, for another three clock cycles the grippers continue to move downward.

When the counters represent address 34, the data word read out is 01001100. The only difference between this data word and the preceding data words is in the most significant bit. Since data bit DB7 is now a 0, the A5 conductor goes low and the motor stops operating. The grippers thus remain stationary. However, because data bits DB2, DB3 and DB6 are still 1's, the grippers remain closed (DB2), the stand remains under the bagging apparatus (DB3), and the clock continues to run (DB6) since the DE conductor is still high so as to allow the high BSENS signal to hold the clock enabled.

The data words at addresses 35 through 37 are the same as the data word at address 34. A few clock cycles are allowed for the motor to come to rest. (The motor is braked electromechanically by the line power being removed from the B inputs.) The next data word read out, from address 38, is 00001100. The only change from the preceding data word is in data bit DB6; the DE conductor goes low. The photocell detector is no longer required to sense the bottom of a garment, and by causing the DE conductor to go low, the BSENS conductor no longer has any effect on the running of the clock. Two clock cycles are allowed for this purpose; the data word at address 39 is the same as the data word at address 38. Although the DE conductor is now low, gate 809 is off to force the output of gate 852 high to keep the clock running.

The next location in the memory which is accessed is that having address 40, the data word stored at this location being 00101100. The only difference between this data word and the preceding data word is that data bit DB5 is now a 1. This data bit output of the memory is connected to the CC ("cutter close") conductor. The CC conductor is connected to one input of gate 822. The other input to this gate is connected to the output of gate 808. Assuming for the moment that the output of gate 808 is high, gate 822 operates to apply a high potential on conductor A7. This is the conductor which actuates the cutter solenoid; the cutter bar now moves forward to cut the bag.

The only exception to this sequence is if the grippers have not moved down far enough by the time the bottom of the garment is sensed. This is the situation when a very short garment is being bagged. Should the grippers not move down far enough, the cutter may actually hit them as it moves forward toward the plastic. Gate 808 and detector D8 are provided to prevent this from happening. Detector D8 is a normally-closed switch so that a low potential normally appears at one of the inputs to gate 808. Consequently, the output of gate 808 (TGARD) is normally high so that the 1 bit at the DB5 memory output can be extended through gate 822 to conductor A7. However, contacts D8 are held open whenever the grippers are above the "safe" level for the cutter blade to operate. If the grippers are too high, then that input of gate 808 connected to detector D8 is high in potential and conductor A7 is not energized.

The other input to gate 808 is connected to the output of inverter 880. The input to this inverter is connected to the TOP conductor. This conductor is connected to the output of inverter 840 which is controlled by detector D6. Detector D6 is positioned above detector D8 and is the detector which operates when the grippers move up to the highest position. As will be described below, it is the opening of contacts D6 which stop the upward movement of the grippers. The same cam controls both detectors D6 and D8. During normal operation the grippers are moved up past the position at which detector D8 operates to the position at which detector D6 operates. With contacts D6 open, the output of inverter 840 is low in potential, the inverter output being connected to the TOP conductor. With this conductor being low in potential, the output of inverter 880 is high. As long as the output of the inverter is high, gate 808 cannot cause the TGARD conductor to go high; cutter blade actuator A7 is disabled. (This is an added safety precaution.) As the grippers start to move downward during a normal bagging operation, contacts D6 close and thus the output of inverter 880 goes low. Thus gate 808 can control the TGARD conductor to go high. To make sure that the grippers move down sufficiently so that the cutter blade clears them, detector D8 is connected to another input of gate 808. Until the grippers have cleared this switch as well as the upper one, the TGARD conductor is prevented from going high.

In the event actuator A7 is not energized, the system goes through a normal sequence, the only difference being that the cutter blade and heater bar do not operate. Consequently, when the turntable is next indexed, the garment on the stand at position P2A moves back toward the center of the index table — out of the plastic tubing which is around it — and then around to position P3. There is thus a little extra length of plastic tubing extending down at the top of the machine. When the grippers move up at the end of the cycle in progress they simply push up the bottom of the plastic tubing as they grip it. The net result is that there may be a little excess plastic tubing stuck within the grippers which, in turn, result in a slightly longer bag on the next garment than is required.

During a normal operation, when the data word at address 40 is read out, the cutting and sealing assembly is actuated (actuator A7) and the cutter moves in toward the plastic. Referring to FIG. 21, arrow CC represents the direction in which the cutter blade moves. A cam or pin on the rail 260 moves past detectors (microswitches) D4 and D5. As shown by the arrows under these detectors, microswitch D4, which is the first to have the cam on the rail pass under it, does not operate while the cutter blade is moving in the forward or right to left direction. It is only detector D5 which is operated by the cam on the rail during the forward motion. As soon as detector D5 operates, actuator A10 is energized. Solenoid 876 is pulsed in the direction which opens an air valve to control movement of the heater bar or element 208 toward the plastic. Only a short pulse is required on conductor 810 to trigger and maintain motion of the heater bar. The heater bar actually reaches the plastic tubing 0.3 seconds prior to the cutting blade.

The locations at addresses 41 through 49 contain the same data word as that at address 40. The number of data words read out of the memory is determined by the time required for the cutter blade to cut the plastic and for the heater bar to initiate a seal. Both operations have been completed by the time counters 802 and 804 represent an address 50.

The data word at address 50 is 00001100. The only change from the preceding data word is that data bit DB5 is now a 0. The actuating signal for solenoid 876 on conductor A10 is released. However, the cutter blade and the heating bar remain in position, the cutter blade now having passed through the plastic tubing and the heater bar now effecting a seal. This condition persists as the same data word is read out from addresses 50 through 54.

The next data word which is read out is that stored at address 55, the data word being 00011100. The new change is in data bit DB4, which appears on the CO ("cutter open") conductor. The CO conductor is connected directly to actuator conductor A8. This is the actuator for the solenoid which controls the retraction of the cutter blade. (Signals A7 and A8 are fed to different inputs of the same solenoid, for controlling opening and closing of an air valve.) As the cutter blade starts to move in the reverse direction, the cam on rail 260 first passes under detector (microswitch) D5. Referring to FIG. 21, this microswitch is not operated when the cutter blade is retracted. However, when the cam reaches microswitch D4, it is operated and a pulse is applied to actuating conductor A11. The pulse on this conductor operates solenoid 876 in the reverse direction, moving an air valve so that the heater bar is now retracted. The use of two microswitches D4 and D5 allows the heater bar to remain in a sealing position for a slightly longer interval to insure that an adequate seal is made. With the pulsing of conductors A8 and A11, the cutter blade and the heater bar are returned to their retracted positions. The data words at addresses 55 through 64 are all 00011100; as these addresses are accessed, the cutter blade and the heater bar are withdrawn.

Although the bag has been completely formed, it will be recalled that the grippers have not yet reached the bottom of the bag, the grippers having remained stationary during the cutting and sealing operation. Similarly, since the cutting blade and the sealing elements are necessarily disposed above the garment, it is apparent that there is a short length of bag above the garment. The machine now operates so as to cause the grippers to move downward so that the bag is pulled approximately six inches, at which point the top of the bag is at the top of the garment and the bottom of the bag is at the bottom of the garment.

The data word stored at address 65 is 00001100. Actuators A2 and A3 are the only ones which are held on; actuator A8 which was previously energized is now deenergized. The stand is still held underneath the bagging mechanism (A3) and the grippers are still held closed (A2). No other operations take place as the data words at addresses 65 through 70 are read out, all of these data words being the same. A "rest" interval is provided simply to separate in time the turning on and turning off of the several solenoids in the system.

It is when the data word at address 71 is read out that the grippers start to move once again in the downward direction. The data word at this address is 10001100. There is only one change in this data word from the preceding data word, namely, in the most significant bit. With data bit DB7 being a 1, the motor is energized once again and the grippers move in the downward direction, since conductor A6 is still not energized and relay 864 has its contacts in the positions which control downward movement of the grippers.

The same data word is read out of the memory until the counters represent an address of 77. At this time the output data word is 10001000. Sufficient time has elapsed for the grippers to pull the plastic to the bottom of the bag. Consequently, data bit DB2 is made a 0 so that the actuating signal on conductor A2 goes low; the grippers release. The stand is still pushed out (P2A) since data bit DB3 is a 1, and the grippers still move downward since data bit DB7 is a 1. The same data word is read out until address 83 is reached, by which time the grippers are positioned below the bottom edge of the bag.

At address 83, the data word consists of eight 0's. The two previously high actuating signals (A5) and A3) go low. With signal A5 going low, the motor stops operating and the grippers remain at the level which they reached below the bottom of the bag. With actuating signal A3 going low, inverter 820 applies a high signal to conductor A4. As long as this conductor is held high in potential, the stand is retracted (P2). Consequently, the bagged garment is retracted to its innermost position along a radial line extending through the center of the turntable.

The data word at address 84 is the same as that at address 83. The next change is in the data word at address 85, this data word being 00000010. The DB1 output of the memory, connected to the R ("reverse") conductor, now goes high. Conductor A6 thus goes high to operate solid-state relay 862. The relay thus connects a positive potential to the relay winding so that the relay contacts shift position. Since actuating signal A5 is still low, motor 860 does not operate. But the next time that actuating signal A5 is generated, the motor will run in the reverse direction due to the shifting of the contacts of relay 864.

The R conductor is extended to one input of gate 854. This is the gate which controls the resetting of flip-flop 842, as will be described below.

The data words stored at addresses 86 through 94 are the same as that stored at address 85. The only effective operation as these data words are read out is the energization of relay 864. A sufficient time is allowed for the relay contacts to stabilize, following the energization of relay 862.

When address 95 is reached, the data word read out is 10000110. The 1 in data bit DB1 holds relay 864 energized so that the relay contacts control the reverse operation of the motor. The DB2 bit causes conductor A2 to go high. Although the grippers will now move upwardly, just in case the stand is not yet retracted, a precaution is taken so that the grippers do not grip the plastic. It is for this reason that they are shut as they begin their upward movement. The motor also now starts to operate since data bit DB7 is a 1; the grippers move upwardly. The same data word is read out as counters 802 and 804 cycle from address 95 through address 104.

The data word at address 105 is 10000111. There is no change in the seven most significant bits; relay 864 remains energized (A6) so the grippers move upwardly (A5), and the grippers remain closed (A2). But now that the least significant bit is a 1, the turntable is caused to index. Data bit DB0 is connected to the TRN ("turn") conductor which is extended to one input of gate 814. A second input of this gate is connected to the R conductor which is high in potential because the grippers are moving upwardly. The third input of the gate is connected to the M conductor which is similarly high since the motor is operating. With all three inputs to gate 814 being high, the output goes low. Since the output of gate 814 is connected to one of the inputs of gate 816, the output of the gate goes high (just as it does when switch 28C is momentarily closed in order to initially start the machine). When conductor A1 goes high, the positive step applied to the turntable causes it to index.

The same data word is read out of the memory until address 115 is reached. The data word stored at address 115 is used to reset the system preparatory to another cycle. The actual stopping of the upward movement of the grippers is not under control of the memory. When address 115 is reached, the data word read out is 11000010. The motor is still operated (DB7, A5) in the reverse direction (DB1, A6). Data bit DB2 is now a 0 so that the grippers open when conductor A2 goes low. Because data bit DB6 is now a 1, the DE conductor goes high in potential. The high potential on this conductor enables one input of gate 850, but the gate is not used at this time for any effective purpose. Instead, the DB2 bit, together with the DB1 and DB7 bits, function as a code to remove the sequence from memory control.

The DE, R and M conductors, all of which are high at this time, are connected to three inputs of gate 854. A 1 in each of data bit positions DB1, DB6 and DB7 is used as a code for re-setting the system, the three bits energizing three inputs of gate 854. The fourth input of the gate is connected to clock conductor 830, and the first $\phi 2$ clock pulse which is generated after the data word at address 115 is read out causes gate 854 to operate. When the output of the gate goes high, the K input to flip-flop 842 goes high.

Address 115 is actually accessed during the indexing of the turntable, at which time the BPOS conductor is low. Consequently, the J input of the flip-flop is low at the same time that the K input goes high. The next clock pulse from clock 844 causes the flip-flop to reset. As soon as the Q output goes high, the high potential on the ONHK conductor resets counters 802 and 804 and disables the memory. Consequently, the last address of the memory which is actually accessed is 115.

The only reason for providing the same data word 11000010 at addresses 116–124 is just in case the counters somehow fail to generate address 115; when they generate one of the next addresses the same "reset" code is read out. The last operative address is 115. In the illustrative embodiment of the invention, the last operative data word is stored at the next several addresses. All higher addresses (through address 255 since a typical ROM contains 256 storage locations) contain data words which consist of all 0's, i.e., No OP codes, although FIG.22 shows the data words stored only through address 135.

When the indexing, under control of the turntable, is complete, the BPOS conductor goes high. Since another garment is now at position P2 and has been detected by detector D1, the output of inverter 836 is also high, thus enabling the second input of gate 838. But since the grippers do not reach the uppermost position by the time the indexing has been completed, contacts D6 are still closed. Thus although two inputs to gate 838 are high, the third input is low. The output of the gate is low to hold flip-flop 842 in the reset condition.

When the flip-flop is first reset, conductor ONHK goes high in potential as described above, counters 802 and 804 are reset, clock 846 is disabled, and memory 800 is disabled. The ONHK conductor is applied to the enable input of each of amplifiers 812-TRN through 812-M so that it is now these amplifiers which control the actuator signals.

Five of these amplifiers have their inputs connected to ground so that their outputs are held low. The outputs of these amplifiers are connected to conductors DE, CC, SP, CG and TRN. With the CG (A2) output being low, the grippers stay open. The TOP conductor is connected to the inputs of amplifiers 812-M, 812-CO and 812-R. This conductor is connected to the output of inverter 840, whose input is connected to microswitch D6. Until the grippers reach their uppermost position, switch D6 remains closed since it is a normally-closed switch that opens only when the grippers move to the maximum upward position. The conductors M, CO and R are forced high. With conductor R (A6) high, relay 864 remain energized so that the motor continues to move in the reverse direction. The motor is actually energized by the high potential on the A5 conductor. Gate 810 is still operated since the several signals for controlling it have not changed; the output of the gate causes actuator conductor A5 to remain high so that motor 860 continues to operate. The CO (A8) conductor is held high in potential only as a safety precaution to make sure that the cutter blade remains in the retracted position.

As soon as the grippers move to the uppermost position, contacts D6 open. At this time, the TOP conductor goes low, and the M (A5) and R (A6) conductors go low. This causes relay 864 to de-energize preparatory to a required forward movement of the motor (downward movement of the grippers) in the next cycle. Motor 860 also turns off since the grippers have moved to the uppermost position. At the same time that the TOP conductor goes low, gate 838 operates because of the opening of switch D6—provided that a new garment is detected by photocell detector D1—to set flip-flop 842. The Q output goes high to enable the running of clock 848, and the Q output (ONHK) goes low to enable the operation of counters 802 and 804, and memory 800, and to disable the operations of amplifiers 812-TRN through 812-M.

Thus far, the system has been described without reference to the mechanism for raising the lift bar 450 to remove a garment from the stand at position P4. Detector D3 (FIG. 21) is closed whenever the turntable is stationary at one of the indexed positions. During the turning of the turntable, contacts D3 are open. Assume that an indexing operation has just been completed and that contacts D3 have just closed. Immediately upon the completion of the indexing, a positive potential is applied to the input of one-second delay element 874. This element delays the positive potential from appearing on actuating conductor A9 for one second. After the one-second delay period, by which time the stand at position P4 has stopped vibrating, solenoid A9 is energized. The lift bar rises and lifts the garment from the stand, the garment automatically being released when the lift bar reaches its uppermost position. At the start of the next indexing cycle, contacts D3 open. The ground potential at the input of delay element 874 is immediately transmitted to conductor A9 (the delay element delays only the positive step), and immediately when the turntable starts to index, the lift bar starts to drop down. The lift bar returns to its lowermost position before the indexing is complete, so that the lift bar will be below the hanger hook which moves into position at the end of the indexing step.

Detector D9 (FIG. 21) is a microswitch which is positioned below microswitch D7. Detector D7 detects the movement of the grippers to the lowermost "emergency" position during a downward movement, as will be described.

When the grippers have moved down to the vicinity of the bottom of the lowest garment which can be accommodated, the BLIM conductor goes high. This occurs during a downward movement when the DB1 bit is a 0, that is, the R (A6) conductor is low in potential so that the motor 860 moves in the forward direction. With a low potential on the R (A6) conductor, the output of inverter 818 is high. With both inputs to gate 824 high, the output goes low to disable gate 810 and to cause the motor actuating conductor A5 to go low. The motor thus shuts off. The grippers remain in the lowermost position until the memory sequence continues to the point at which the R conductor goes high. Now that relay 864 is energized to control reverse movement of the motor (upward movement of the grippers), there is no longer any reason to disable actuator conductor A5. When the output of inverter 818 goes low, gate 824 applies a high potential to one input of gate 810 despite the fact that the BLIM conductor is still high in potential. (The net result is that the bag which is formed on the garment is a little short, but that is only because an excessively long garment was placed on the stand in the first place).

Detector D9 is provided to safeguard against flip-flop 842 somehow being reset erroneously, e.g., due to noise; the grippers may "crash" into the bottom of the machine in such a case. A conventional capacitive-starting motor, such as motor 860, once it is moving in the forward direction, does not reverse direction if the field winding is reversed during the forward motion. If the grippers are moving downward under memory control, relay 864 is de-energized. As soon as the flip-flop is erroneously reset, the high ONHK signal causes the R conductor to go high, thus forcing the output of gate 824 to go high—even if the BLIM conductor goes high. The energization of relay 864 has no effect; the motor continues to move in the forward direction. Thus even if the grippers actuate switch D7, the BLIM signal cannot disable gate 810, and the grippers may "crash". Switch D9 prevents this. If the D9 position is reached by the grippers, contacts D9 (FIG. 21) open to cut off the armature current and to enable the motor brake.

In order to resume the machine operation, pushbutton 28D is operated momentarily. By now, the motor has come to a stop, so that when power is applied to the armature winding once again, the motor moves in the reverse direction since relay 864 is energized. With flip-flop 842 in the reset state and the Q output high, amplifiers 812-M, 812-CO and 812-R control the sequencing of the system through the terminal portion of the cycle in the usual manner. As soon as the motor starts to turn in the reverse direction and the grippers move upward, emergency limit switch D9 closes so that pushbutton 28D can be released.

Although the invention has been described with reference to a particular embodiment, it is to be understood that this embodiment is merely illustrative of the application of the principles of the invention. For example, although it is preferred to use a clocked read-only-memory for controlling the machine cycle, any conventional process controller, or even a microprocessor, may be used to cycle the machine through its several steps and functions. Thus, it is to be understood that numerous modifications may be made in the illustrative embodiment of the invention and other arrangements may be devised without departing from the spirit and scope of the invention.

What is claimed is:

1. Apparatus for automatically placing garments into garment bags, including:

a. means for locating a garment at a loading station;
b. means for transporting said garment from its location at said loading station, to an operative station, to an unloading station;
c. means for supplying a length of tubular material;
d. means for forming a garment bag from the tubular material over a garment located at the operative station;
e. means for sizing said garment bag so that it has a length corresponding to the length of the garment,
f. control means for actuating the means of paragraphs (a) through (e) in sequence, as a function of the presence of a garment at the operative station,
g. at least three stands for supporting hangers with said garments suspended therefrom;
h. said means for transporting comprising means for moving each of said at least three stands in sequence to at least first, second and third positions, each of said stands remaining stationary for a brief interval at each of said positions following its arrival thereat, each of said stands being adapted to have a hanger-suspended garment mounted thereon when said each stand is at said first position;
i. means at said second position for pulling down tubular material from a supply thereof over a garment at said second position, and for cutting and sealing the tubular material above the garment to form a bag therefor, said means being operative to form a bag whose length is commensurate with the length of the garment at said second position, and
j. means for lifting a bagged hanger - suspended garment from a stand at said third position, wherein said stand moving means includes means for moving said stands in a circle, said first and third positions being located on the circumference of said circle, and means for pushing each of said stands out from the center of said circle to said second position, said second position being located outside said circle.

2. Apparatus for automatically placing garments into garment bags as set forth in claim 1, further including a storage area for garments, means for transferring the bagged garment from the unloading station to the storage area and wherein the control means actuates said transferring means.

3. Apparatus for automatically placing garments into garment bags as set forth in claim 2, wherein the transferring means includes a slide having an entrance and an exit end, said slide being adapted to receive the hook portion of a garment hanger, said exit end being in alignment with the storage area, and means for shifting a bagged garment from the unloading station to the entrance end of the slide.

4. Apparatus for automatically placing garments into garment bags as set forth in claim 3, wherein the entrance end of the slide is elevated and the exit end of the slide is depressed, so that a hanger placed on the slide at its entrance end will slide by virtue of the force of gravity downwardly towards the exit end of the slide.

5. Apparatus for automatically placing garments into garment bags as set forth in claim 3, wherein each stand has a hanger retention member at an upper portion thereof, the hanger retention members of each stand being substantially at the same height, and wherein the shifting means includes a hanger support arm, means for moving the hanger support arm through a path having a substantially vertical component from a lowermost position below the level of the hanger retention member to a position at the level of the entrance end of the slide, the path of the hanger support arm intersecting the hanger retention member on the stand situated at the unloading station.

6. Apparatus for automatically placing garments into garment bags as set forth in claim 5, wherein said shifting means further includes camming means for moving the hanger in a path having a substantially horizontal component along the hanger support arm.

7. Apparatus for automatically placing garments into garment bags as set forth in claim 1, wherein the transporting means includes a turntable, stands for receiving garments, the stands being mounted on said turntable and means for indexing the turntable so that the stands in turn rotate from the loading station to the operative station to the unloading station.

8. Apparatus for automatically placing garments into garment bags as set forth in claim 7, further including guide means for establishing a path for the tubular material from the supply means, the transporting means further including means for shifting a stand when the stand is at the operative station to a position in alignment with the path for the bagging material.

9. Apparatus for automatically placing garments into garment bags as set forth in claim 8, wherein the stand shifting means includes a slide assembly mounted on the turntable, the slide assembly carrying a garment stand, and drive means for reciprocating the slide assembly into and out of its alignment position.

10. Apparatus for automatically placing garments into garment bags as set forth in claim 9, wherein four stands are situated on the turntable and four slide assemblies are mounted on the turntable, each slide assembly carrying one stand, and further wherein the loading station and the operative station are substantially 90 degrees apart and the indexing means rotates the turntable through arcs of substantially 90 degrees so that each stand in turn moves from the loading station to the operative station.

11. Apparatus for automatically placing garments into garment bags as set forth in claim 1, further including guide means for establishing a path for the tubular material from the supply means to the operative station, the supply means including auxilliary tubular material drive means for frictionally engaging the tubular material, said auxilliary tubular material drive means operating only upon the application of tension to the tubular material.

12. Apparatus for automatically placing garments into garment bags as set forth in claim 1, further including (g) guide means for establishing a path for the tubular material from the supply means to the operative station, said guide means including means for separating and maintaining the faces of the tubular material apart, (h) means for placing the tubular material over a garment carried by a stand located at the operative station, (i) means for sealing and cutting the tubular material at a location above the garment, (j) the control means actuating the means of paragraphs (g) through (i) in sequence.

13. Apparatus for automatically placing garments into garment bags as set forth in claim 12, wherein the placing means includes means for gripping the leading end of the tubular material and means for moving the gripping means between a position above the garment to a position adjacent the lower end of a garment.

14. Apparatus for automatically placing garments into garment bags as set forth in claim 13, wherein the gripping means includes a pair of gripping claws, a bar, means mounting the gripping claws on the bar so that they grip the material at opposite sides thereof and maintain the leading end of the tubular material in an open condition.

15. Apparatus for automatically placing garments into garment bags as set forth in claim 14, wherein the claw mounting means adjustably mounts the gripping claws through different separations on the bar so that the gripping claws can grip tubular material of different widths.

16. Apparatus for automatically placing garments into garment bags as set forth in claim 14, wherein said supply means includes auxilliary tubular material drive means for frictionally engaging the tubular material, said auxilliary tubular material drive means operating only upon the application of tension to the tubular material.

17. Apparatus for automatically placing garments into garment bags as set forth in claim 16, wherein the auxilliary tubular material drive means includes an elongated drive shaft, clutch means enabling rotation of the drive shaft in only one direction, means for rotating the drive shaft so as to transport the tubular material along the path and means for actuating the rotating means upon actuation of the gripping moving means when the gripping claws transport the leading end of the tubular material from the position above the garment to the position adjacent the lower end of the garment.

18. Apparatus for automatically placing garments into garment bags as set forth in claim 17, wherein the drive shaft has an adherent surface.

19. Apparatus for automatically placing garments into garment bags as set forth in claim 12, wherein said means for separating and maintaining the opposite faces of the tubular material apart includes a plurality of substantially spherical light-weight balls, a cage maintaining said balls substantially transverse of the path of the tubular material, the balls being freely rotatable within the cage, and the tubular material passing about the balls as the tubular material moves through the path.

20. Apparatus for automatically placing garments into garment bags as set forth in claim 19, wherein the balls are hollow and the cage is external of the tubular material.

21. Apparatus for automatically placing garments into garment bags as set forth in claim 20, wherein the cage includes a pair of elongated parallel guide bars, the tubular material passing externally of the balls and between the guide bars, and the balls being retained by the guide bars.

22. Apparatus for automatically placing garments into garment bags as set forth in claim 21, wherein each ball has at least one aperture defined therein.

23. Apparatus for automatically placing garments into garment bags as set forth in claim 19, wherein said means for separating and maintaining the opposite faces of the tubular material apart further includes vacuum means for holding the tubular material open, said vacuum means including a pair of vacuum faces, each vacuum face operating on a different face of the tubular material.

24. Apparatus for automatically placing garments into garment bags as set forth in claim 12, wherein the sealing and cutting means includes a non-stick surface elongated transversely of the length of the path, means for pressing the tubular material against the non-stick surface and means for heating the non-stick surface for pre-determined periods of time.

25. Apparatus for automatically placing garments into garment bags as set forth in claim 24, wherein the heating means further includes a heating element, and means for moving the heating element into and out of contact with the non-stick surface when the pressing means presses the tubular material against the non-stick surface.

26. Apparatus for automatically placing garments into garment bags as set forth in claim 12, wherein the sealing and cutting means includes a cutting edge, means for moving the cutting edge through a path transversely of the path of the tubular material so as to at least partially sever the tubular material along a cut line and means for pressing the tubular material at a location adjacent said cut line, the pressing means compressing the tubular material prior to the cutting edge severing the material.

27. Apparatus for automatically placing garments into garment bags as set forth in claim 26, further including means for sensing the bottom edge of a garment carried on a stand at the operative station, the control means controlling movement of the gripping moving means, the control means actuating the sealing and cutting means upon the detection by the sensing means of said bottom edge of a garment so as to form a seal line in the tubular material and so as to sever the tubular material, the control means then causing further movement of the gripping moveing means through a distance such that the seal line rests upon the upper edge of said garment.

28. Apparatus for automatically placing garments into garment bags as set forth in claim 27, wherein the sensing means includes photoelectric detection means mounted for movement with the gripping moving means, said sensing means further including a reflecting surface mounted on the turntable, said reflecting surface being elongated axially of the turntable.

29. Apparatus for automatically forming bags in accordance with claim 1, wherein said stand moving means includes means for moving said stands in a circle, said first and third positions being located on the circumference of said circle, and means for pushing each of said stands out from the center of said circle to said second position, said second position being located outside said circle.

30. Apparatus for automatically forming bags in accordance with claim 1, wherein said means at said second position first pulls down said tubular material until the lower edge thereof is disposed above the bottom of the garment and then stops pulling down said tubular material as it is cut and sealed, the top of the bag which is formed being disposed above the top of the hanger which supports the garment at said second position, and said means at said second position then continues to pull down the formed bag until the top of the bag is in contact with the top of the garment.

31. Apparatus for automatically forming bags in accordance with claim 30, wherein said means at said second position includes means for gripping an edge of said tubular material for pulling it down, said gripping means being controlled to release said edge after the top of the bag is in contact with the top of the garment and to continue moving in the downward direction whereby said gripping means is separated from the bottom edge of the bag to prevent said gripping means from interfering with movement of the bagged garment away from said second position, and means for moving said gripping means in the upward direction to a position adjacent the cut edge of the tubular material preparatory to the formation of another bag for another garment moved to said second position.

32. Apparatus for automatically forming bags in accordance with claim 31, wherein said means at said second position inhibits the cutting and sealing of said tubular material in the event the garment at said second position has a length less than a predetermined length.

33. Apparatus for automatically forming bags in accordance with claim 31, further including means for sensing downward movement of said gripping means to a predetermined lower limit and in response thereto for inhibiting further downward movement of said gripping means.

34. Apparatus for automatically forming bags in accordance with claim 1, wherein said means at said second position first pulls down said tubular material until the lower edge thereof is disposed above the bottom of the garment and then stops pulling down said tubular material as it is cut and sealed, the top of the bag which is formed being disposed above the top of the hanger which supports the garment at said second position, and said means at said second position then continues to pull down the formed bag until the top of the bag is in contact with the top of the garment.

35. Apparatus for automatically forming bags in accordance with claim 34, wherein said means at said second position includes means for gripping an edge of said tubular material for pulling it down, said gripping means being controlled to release said edge after the top of the bag is in contact with the top of the garment and to continue moving in the downward direction whereby said gripping means is separated from the bottom edge of the bag to prevent said gripping means from interfering with movement of the bagged garment away from said second position, and means for moving said gripping means in the upward direction to a position adjacent the cut edge of the tubular material preparatory to the formation of another bag for another garment moved to said second position.

36. Apparatus for automatically forming bags in accordance with claim 35, wherein said means at said second position inhibits the cutting and sealing of said tubular material in the event the garment at said second position has a length less than a predetermined length.

37. Apparatus for automatically forming bags in accordance with claim 35, further including means for sensing downward movement of said gripping means to a predetermined lower limit and in response thereto for inhibiting further downward movement of said gripping means.

38. Apparatus for automatically forming bags in accordance with claim 1, wherein said means at said second position includes means for gripping an edge of said tubular material for pulling it down, said gripping means being controlled to release said edge after a bag is formed around the garment and to continue moving in the downward direction whereby said gripping means is separated from the bottom of the garment to prevent said gripping means from interfering with movement of the bagged garment away from said second position, and means for moving said gripping means in the upward direction to a position adjacent the cut edge of the tubular material preparatory to the formation of another bag for another garment moved to said second position.

39. Apparatus for automatically forming bags in accordance with claim 38, further including means for sensing downward movement of said gripping means to a predetermined lower limit and in response thereto for inhibiting further downward movement of said gripping means.

40. Apparatus for automatically forming bags in accordance with claim 1, wherein said means at said second position inhibits the cutting and sealing of said tubular material in the event the garment at said second position has a length less than a predetermined length.

41. Apparatus for automatically placing garments into garment bags, including:

a. means for locating a garment at a loading station;
b. means for transporting said garment from its location at said loading station, to an operative station, to an unloading station;
c. means for supplying a length of tubular material;
d. means for forming a garment bag from the tubular material over a garment located at the operative station;
e. means for sizing said garment bag so that it has a length corresponding to the length of the garment, and
f. control means for actuating the means of paragraphs (a) through (e) in sequence, as a function of the presence of a garment at the operative station; and further including;
g. guide means for establishing a path for the tubular material from the supply means to the operative station, said guide means including means for separating and maintaining the faces of the tubular material apart;
h. means for placing the tubular material over a garment carried by a stand located at the operative station;
i. means for sealing and cutting the tubular material at a location above the garment;
j. the control means actuating the means of paragraphs g. through i. in sequence, wherein the placing means includes means for gripping the leading end of the tubular material and means for moving the gripping means between a position above the garment to a position adjacent the lower end of a garment, and further including means for sensing the bottom edge of a garment carried on a stand at the operative station, the control means controlling movement of the gripping moving means, the control means actuating the sealing and cutting means upon the detection by the sensing means of said bottom edge of a garment so as to form a seal line in the tubular material and so as to sever the tubular material, the control means then causing further movement of the gripping moving means through a distance such that the seal line rests upon the upper edge of said garment, wherein the sensing means includes photoelectric detection means mounted for movement with the gripping moving means, said sensing means further including a reflecting surface mounted on the turntable, said reflecting surface being elongated axially of the turntable, wherein the sensing means determines the presence of a garment at the operative station and further including means for mounting the photoelectric detection means for movement relative to the gripping moving means between a position at which the photoelectric detection means and the gripping claws are adjacent each other and a position at which the photoelectric detection means and the gripping claws are distant each other, and means for moving the photoelectric detection means from its distant position to its adjacent position upon initiation of movement of the gripping moving means in a downward direction.

42. Apparatus for automatically placing garments into garment bags as set forth in claim 41, wherein when the photoelectric detection means is at its distant position relative to the gripping claws and when a garment is carried by a garment stand at the operative station, the photoelectric detection means detects the presence of said garment.

43. Apparatus for automatically placing garments into garment bags as set forth in claim 41, wherein said means for mounting the photoelectric detection means includes means for biasing said photoelectric detection means toward the adjacent position relative to the gripping claws and stop means acting against said biasing means for preventing movement of said photoelectric detection means so that the photoelectric detection means assumes its distant position relative to the gripping claws, when the gripping claws are in their uppermost position.

44. Apparatus for automatically placing garments into garment bags including:

a. means for locating a garment at a loading station;
b. means for transporting said garment from its location at said loading station, to an operative station, to an unloading station;
c. means for supplying a length of tubular material;
d. means for forming a garment bag from the tubular material over a garment located at the operative station;
e. means for sensing said garment bag so that it has a length corresponding to the length of the garment comprising gripping means to grip the edge of the tubular material and means to move the gripping means, and
f. control means for actuating the means of paragraphs (a) through (e) in sequence, as a function of the presence of a garment at the operative station;

wherein the sensing means determines the presence of a garment at the operative station and further including means for mounting a photoelectric detection means for movement relative to gripping means between a position at which the photoelectric detection means and the gripping means are adjacent each other and a position at which the photoelectric detection means and the gripping means are distant each other, and means for moving the photoelectric detection means from its distant position to its adjacent position upon initiation of movement of the gripping moving means in a downward direction.

* * * * *